United States Patent [19]

Hirano et al.

[11] Patent Number: 4,877,723

[45] Date of Patent: Oct. 31, 1989

[54] SILVER HALIDE PHOTOGRAPHIC MATERIAL COMPRISING A SPECIFIED NUCLEATING AGENT

[75] Inventors: Shigeo Hirano; Noriyuki Inoue; Tatsuo Heki, all of Kanagawa, Japan

[73] Assignee: Fuji Photo Film Co., Ltd., Kanagawa, Japan

[21] Appl. No.: 117,725

[22] Filed: Nov. 6, 1987

[30] Foreign Application Priority Data

Nov. 10, 1986 [JP] Japan ..... 61-266866

[51] Int. Cl.[4] ..... G03C 1/48; G03C 1/06

[52] U.S. Cl. ..... 430/598; 430/410; 430/600; 430/940

[58] Field of Search ..... 430/598, 600, 410, 940

[56] References Cited

U.S. PATENT DOCUMENTS 4,115,122 9/1978 Adachi et al. ..... 430/598

4,471,044 9/1984 Parton et al. ..... 430/598

*Primary Examiner*—Paul R. Michl

*Assistant Examiner*—Patrick A. Doody

*Attorney, Agent, or Firm*—Sughrue, Mion, Zinn, Macpeak & Seas

[57] ABSTRACT

A silver halide photographic material which comprises a support having provided thereon at least one photosensitive silver halide photographic emulsion layer, wherein the emulsion layer or at least one of the other hydrophilic colloid layers contains at least one of alkynyl-substituted heterocyclic quaternary ammonium salts represented by the formula:

(I)

wherein Z represents a group of non-metallic atoms required to form a 5- to 6-membered heterocyclic ring, $R^1$ represents an aliphatic group, $R^2$, $R^3$ and $R^4$, which may be the same or different, each represents a hydrogen atom, an aliphatic group, or an aromatic group, at least one of $R^1$, $R^2$, $R^3$, $R^4$ and Z has at least one substituent having an alkynyl group, Y represents a counter ion for the charge balance, and n is a number required for charge balance.

10 Claims, No Drawings

SILVER HALIDE PHOTOGRAPHIC MATERIAL COMPRISING A SPECIFIED NUCLEATING AGENT

FIELD OF THE INVENTION

The present invention relates to a silver halide direct positive photographic material that forms a latent image mainly inside the grains and is characterized in that said silver halide direct positive photographic material contains a novel nucleating agent and relates to a negative type silver halide photographic material that forms a latent image mainly on the surface of the grains and is characterized in that said negative type silver halide photographic material contains a novel nucleating agent.

BACKGROUND OF THE INVENTION

Conventionally, in silver halide photographic materials, nucleating agents have been used for various purposes. For example, the hydrazines most frequently used as a nucleating agent have been used as a nucleus forming agent in internal latent image type direct positive silver halide emulsions and have been used for increasing the sensitivity and/or the gradation in negative type surface latent image forming silver halide emulsions.

Although there are many direct positive photographic processes, the process wherein previously fogged silver halide grains are exposed to light in the presence of a desensitizer and then are developed and the process wherein a silver halide emulsion having photographic nuclei mainly inside the silver halide grains is exposed to light and then is developed in the presence of a nucleating agent are most useful.

The present invention is directed to the latter process. Silver halide emulsions wherein photosensitive nuclei are present mainly in the silver halide grains and a latent image will be formed mainly within the grains are called an internal latent image type silver halide emulsion and are distinguished from silver halide grains wherein a latent image will be formed mainly on the surface of the grains.

Processes wherein an internal latent image type silver halide photographic emulsion is subjected to surface development in the presence of a nucleating agent to produce a direct positive image and photographic emulsions or photosensitive materials used in said processes are well known, for example, from U.S. Pat. Nos. 2,456,953, 2,497,875, 2,497,876, 2,588,982, 2,592,250, 2,675,318, 3,227,552, and 3,317,322, British Pat. Nos. 1,011,062, 1,151,363, 1,269,640, and 2,011,391, Japanese patent publication Nos. 29405/68 and 38164/74, and Japanese patent application (OPI) Nos. 16623/78, 137133/78, 37732/79, 40629/79, 74536/79, 74729/79, 52055/80 and 90940/80 (the term "OPI" as used herein indicates patent applications which have been laid-open for public inspection).

In the above processes of producing a direct positive image, the nucleating agent may be added to the developing solution, but it is more common to add the nucleating agent to the photographic emulsion layer or other suitable layer of the photosensitive material.

As a nucleating agent to be added to silver halide photosensitive materials, hydrazine compounds are the most well known and are described, for example, in U.S. Pat. Nos. 2,563,785, 2,588,982 and 3,227,552. However, when these hydrazine compounds are used by adding them to a photosensitive material, a substantially higher concentration (for example, about 2 g per mol of silver) of the hydrazine compound is needed and, further, since the nucleating agent diffuses from the emulsion layer to the developing solution during the development process, the concentration of the nucleating agent in the emulsion changes and image density becomes non-uniform. Further, in the case of multilayer color photosensitive materials, the diffusion of the nucleating agent from the emulsion layer breaks the balance of the nucleating action between the emulsion layers, thereby resulting in an imbalance between the colors in the developed image.

To obviate these defects, hydrazine type nucleating agents having a substituent that will be adsorbed on the surface of silver halide grains have been developed. As hydrazine type nucleating agents having an adsorption accelerating group, thiourea linkage type acylphenylhydrazine compounds described, for example, in U.S. Pat. Nos. 4,030,925, 4,031,127, 4,139,387, 4,243,739, 4,245,037, 4,255,511 and 4,276,364, and British Pat. No. 2,012,443 can be mentioned.

Further examples are compounds having an adsorption group such as heterocyclic thioamides described in U.S. Pat. No. 4,080,207; phenylacylhydrazine compounds having a heterocyclic group with a mercapto group as an adsorption group described in British Pat. No. 2,011,397B; sensitizing dyes having a substituent with a nucleating effect in the molecule structure described in U.S. Pat. No. 3,718,470; and the compounds described in Japanese patent application (OPI) Nos. 200230/84, 212828/84 and 212829/84, and *Research Disclosure*, No. 23510 (November, 1953), No. 15162 (Vol. 751, November, 1976) and No. 17626 (Vol. 176, December, 1978).

Generally, when hydrazine type nucleating agents are used, the difference between the maximum density (Dmax) and the minimum density (Dmin) is great and although the hydrazine type nucleating agents are most excellent from the point of view of the high contrast obtained, they are disadvantageous because a high pH ($pH > 12$) is required in development processing.

As nucleating agents that are effective even at a low processing pH ($pH \leqq 12$), heterocyclic quaternary ammonium salts such as those described in U.S. Pat Nos. 3,615,615, 3,719,494, 3,734,738, 3,759,901, 3,854,956, 4,094,683 and 4,306,016, British Pat. No. 1,283,835, and Japanese patent application (OPI) Nos. 3426/77 and 69613/77 are known.

Particularly, heterocyclic quaternary ammonium salt compounds substituted by a propargyl or butynyl group described in U.S. Pat. No. 4,115,122 are excellent nucleating agents in direct positive silver halide emulsions from the point of view of high contrast.

However, in silver halide emulsions, particularly in color photosensitive materials, sensitizing dyes are used for the purpose of spectral sensitization. Since competing adsorption onto the silver halide emulsion occurs between the sensitizing dye and the heterocyclic quaternary ammonium type nucleating agent, a quaternary salt type nucleating agent weak in adsorbability must be added in an amount greater than that which would otherwise be necessary to get the same result.

In particular, in the case of multilayer color photographic materials, sometimes the density becomes nonuniform or an imbalance occurs between the colors in the respective layers after development, and it cannot be said that the performance has been satisfactory with such materials.

To overcome these problems, a quaternary salt type nucleating agents having a thioamide AgX adsorption accelerating group has been suggested in U.S. Pat. No. 4,471,044. Although this patent discloses that the introduction of such an adsorption accelerating group decreases the amount of the nucleating agent needed and further prevents decrease of Dmax at high temperatures over time, the effect is not satisfactory.

On the other hand, although hemicyanine type quaternary salt compounds are described in Japanese patent application (OPI) No. 100426/82, they are not satisfactory with regard to nucleating activity.

It is known that processing a surface latent image type silver halide negative emulsion in the presence of a hydrazine type nucleating agent with a processing solution having a high pH (>11) can produce a high contrast negative image high in gamma (>10) as disclosed, for example, in U.S. Pat. Nos. 2,419,975, 4,224,401, 4,168,977, 4,243,739, 4,272,614 and 4,323,643.

U.S. Pat Nos. 4,385,108 and 4,269,929 disclose examples of hydrazine type nucleating agents having a group capable of accelerating dsorption on silver halide grains. It is also known that when a combination of a negative emulsion and a hydrazine compound is processed at a low pH (<11), sensitivity can be increased.

In a silver halide negative emulsion system, it is known that quaternary ammonium type compounds act to accelerate development as described, for example, in U.S. Pat. No. 4,135,931, Japanese patent application (OPI) Nos. 114328/77 and 121321/77, German Pat. No. 2,647,940, and Belgian Pat. No. 721,568.

SUMMARY OF THE INVENTION

An object of the invention is to provide a direct positive photosensitive material that exhibits enough reversibility (high Dmax and low Dmin) even if processed with a processing solution with a low pH.

Another object of the invention is to provide a direct positive photosensitive material containing a nucleating agent having a desired nucleating effect without impeding spectral sensitization by adding a small amount.

Still another object of the invention is to provide a multi-layer direct positive photosensitive material that will result in uniform density and good color balance and that will provide good graininess even if processed with a fatigued processing solution.

Still another object of the invention is to provide a direct positive photosensitive material that will result in less change in photographic characteristics such as less decrease in the Dmax or less increase in the Dmin with time at high temperatures and/or high humidities.

Still another object of the invention is to provide a direct positive photosensitive material that will hardly result in a high intensity negative image.

A still further object of the invention is to provide a direct positive photosensitive material the progress of the development of which is fast at the initial stage of development.

A still further object of the invention is to provide a negative type photosensitive material whose photographic sensitivity is increased.

The above objects have been attained by a silver halide photographic material which comprises a support having provided thereon at least one photosensitive silver halide emulsion layer, wherein the emulsion layer or at least one of the other hydrophilic colloid layers contains at least one alkynyl-substituted heterocyclic quaternary ammonium salts represented by the formula:

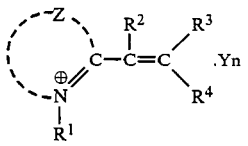

(I)

wherein Z represents a group of non-metallic atoms required to form a 5- to 6-membered heterocyclic ring, $R^1$ represents an aliphatic group, $R^2$, $R^3$ and $R^4$, which may be the same or different, each represents a hydrogen atom, an aliphatic group, or an aromatic group, at least one of $R^1$, $R^2$, $R^3$, $R^4$ and Z has at least one substituent having an alkynyl group, Y represents a counter ion for charge balance, and n is a number required for charge balance.

DETAILED DESCRIPTION OF THE INVENTION

One or more of the substituents on $R^1$, $R^2$, $R^3$, $R^4$ and Z may have $X\text{-}(L_m)\text{-}$ in which X represents a group for accelerating adsorption onto a silver halide, L represents a divalent linking group, and m is 0 or 1.

In the case of a positive type silver halide photographic material, the alkynyl-substituted heterocyclic quaternary ammonium salts of formula (I) are preferably incorporated into an internal latent image type silver halide photographic emulsion layer.

In the case of a negative type silver halide photographic material, the alkynyl-substituted heterocyclic quaternary ammonium salts of formula (I) are preferably incorporated into a surface latent image type silver halide photographic emulsion layer.

With regard to the other hydrophilic colloid layers, the alkynyl-substituted heterocyclic quaternary ammonium salts of formula (I) are preferably incorporated into a hydrophilic colloid layer adjacent to the respective emulsion layers described above.

The heterocyclic ring completed via Z includes a quinolinium nucleus, a benzothiazolium nucleus, a benzimidazolium nucleus, a pyridinium nucleus, a thiazolinium nucleus, a thiazolium nucleus, a naphthothiazolinium nucleus, a selenazolium nucleus, a benzoselenazolium nucleus, an imidazolium nucleus, a tetrazolium nucleus, an indolenium nucleus, a pyrrolinium nucleus, an acridinium nucleus, an isoquinolinium nucleus, an oxazolinium nucleus, a naphthooxazolium nucleus, a naphthopyridinium nucleus, a benzoxazolium nucleus, and a phenanthridinium nucleus and may be substituted or unsubstituted.

Substituents on Z include an alkyl group (preferably one having 1 to 18 carbon atoms, such as a methyl group, an ethyl group, and a cyclohexyl group), an alkenyl group (preferably one having 2 to 18 carbon atoms, such as a vinyl group), an alkynl group (preferably one having 2 to 18 carbon atoms, such as an ethynyl group, a propargyl group, and a butynyl group), an aralkyl group (preferably one having 7 to 20 carbon atoms, such as a benzyl group), an aromatic group (preferably an aryl group having 6 to 20 carbon atoms, such as a phenyl group and a naphthyl group), a hydroxy group, an aliphatic oxy group (e.g., an alkoxy group, an alkenyloxy group, and an alknyloxy group; preferably one having 1 to 18 carbon atoms, such as a methoxy group, an ethoxy group, an aryloxy group, a propargyloxy group, and a butynyloxy group), an aromatic oxy group (preferably one having 6 to 20 carbon atoms, such as a phenyloxy group), a halogen atom (e.g., fluorine, chlorine, bromine, and iodine), an amino group, a substituted amino group (preferably one having 1 to 18 carbon atoms, which may, for example, be one substituted with aliphatic or aryl groups, such as a methylamino group, a dimethylamino group, a propargylamino group, and a phenylamino group), an aliphatic thio group (preferably one having 1 to 18 carbon atoms, such as a methylthio group and a propargylthio group), an aromatic thio group (preferably one having 6 to 20 carbon atoms, such as a phenylthio group), an acyloxy group (preferably one having 1 to 18 carbon atoms, such as an acetoxy group, and a benzoxy group), a sulfonyloxy group (preferably one having 1 to 18 carbon atoms, such as a methaensulfonyloxy group, and a toluenesulfonyloxy group), an acylamino group (preferably one having 1 to 18 carbon atoms, such as an acetylamino group and a benzoylamino group), a sulfonylamino group (preferably one having 1 to 18 carbon atoms, such as a methanesulfonylamino group, and a benzenesulfonylamino group), a carboxyl group, an aliphatic oxycarbonyl group (preferably one having 1 to 18 carbon atoms, such as a methoxycarbonyl group and a propargyloxycarbonyl group), an aromatic oxycarbonyl group (preferably one having 7 to 20 carbon atoms, such as a phenoxycarbonyl group), an acyl group (preferably one having 1 to 20 carbon atoms, such as a formyl group, an acetyl group, and a benzoyl group), a carbamoyl group, an N-substituted carbamoyl group (preferably one having 2 to 20 carbon atoms, such as an N-methylcarbamoyl group, an N-propargylcarbamoyl group, and an N-phenylcarbamoyl group), a sulfamoyl group, an N-substituted sulfamoyl group (preferably one having 1 to 18 carbon atoms, such as an N-methylsulfamoyl group, an N,N-dimethylsulfamoyl group, an N-butenylsulfamoyl group, and an N-phenylsulfamoyl group), a sulfo group, a cyano group, a ureido group, a substituted ureido group (preferably one having 2 to 20 carbon atoms, such as 3-methylureido group, a 3-propargylureido group, and a 3-phenylureido group), a substituted urethane group (preferably one having 2 to 20 carbon atoms, which, for example, may be substituted with an aliphatic or aryl group, such as a methoxycarbonylamino group, a propargyloxycarbonylamino group, and a phenoxycarbonylamino group), a carbonic acid ester group (preferably one having 2 to 20 carbon atoms, such as an ethoxycarbonyloxy group, a propargyloxycarbonyloxy group and a phenoxycarbonyloxy group) and a substituted or unsubstituted imino group (preferably having up to 18 carbon atoms, such as an N-methylimino group, and an N-propargylimino group).

As a substituent on Z, at least one from the above mentioned substituent may be selected. When there are two or more substituents, they may be the same or different.

The above substituents may be substituted by those substituents mentioned above.

Secific examples of heterocyclic rings completed via Z are: (1) a quinolinium nucleus including a quinolinium nucleus, a quinaldinium nucleus, a lepidinium nucleus, a 6-ethoxyquinaldinium nucleus, a 6-propargyloxyquinaldinium nucleus, a 2,4-dimethylquinolinium nucleus, a 3-acetylaminoquinolinium nucleus, and a 6-acetylaminoquinaldinium nucleus; (2) a benzothiazolium nucleus including a 2-methylbenzothiazolium nucleus, a 5-hydroxybenzothiazolium nucleus, a 2-methyl-5-propargyloxybenzothiazolium nucleus, a 2,5,6-trimethylbenzothiazolium nucleus, a 2-methyl-5-phenylbenzothiazolium nucleus, and a 5-chlorobenzothiazolium nucleus; (3) a benzimidazolium nucleus including a 1-ethyl-5,6-dichloro-2-methylbenzimidazolium nucleus, a 1-ethyl-2-methylbenzimidazolium nucleus, and a 5,6-dichloro-2-methylbenzimidazolium nucleus, a 1-ethyl-2-methylbenzimidazolium nucleus, and a 5,6-dichloro-2-methyl-1-phenylbenzimidazolium nucleus; (4) a pyridinium nucleus including a pyridinium nucleus, a 2-methylpyridinium nucleus, a 2,4,6-trimethylpyridinium nucleus, and a 4-phenylpyridinium nucleus; (5) a thiazolinium nucleus including a 2-methyl-2-thiazolinium nucleus and a 2-p-hydroxyphenyl-5-methyl-2-thiazolinium nucleus; (6) a thiazolium nucleus including a thiazolium nucleus, a 2,4-dimethylthiazolium nucleus, and a 2,4,5-trimethylthiazolium nucleus; (7) a naphthothiazole nucleus including an α-naphthothiazolium nucleus, a 5-methoxy-2-methyl-β-naphthothiazolium nucleus, and a 7-hydroxy-2-methyl-α-naphthothiazolium nucleus; (8) a selenazolium nucleus including a selenazolium nucleus and a 2-methyl-4-phenylselenazolium nucleus; (9) a benzoselenazolium nucleus including a benzoselenazolium nucleus, a 5-chloro-2-methylbenzoselenazolium nucleus, and a 5-chloro-2-methylbenzoselenazolium nucleus; (10) an imidazolium nucleus including a 1,2-dimethylimidazolium nucleus and a 1-ethyl-2,4,5-trimethylimidazolium nucleus; (11) a tetrazolium nucleus including a tetrazolium nucleus, a 1-phenyltetrazolium nucleus, a 2-phenyltetrazolium nucleus and a 1,5-dimethyltetrazolium nucleus; (12) an indolenium nucleus including an indolenium nucleus and a 3,3-dimethylindolenium nucleus; (13) a pyrrolinium nucleus including a 2-methylpyrrolinium nucleus; (14) an acridinium nucleus including an acridinium nucleus and a 9-methylacridinium nucleus; (15) an isoquinolinium nucleus including an isoquinolinium nucleus and a 5-hydroxyisoquinolinium nucleus; (16) an oxazolium nucleus including an oxazolium nucleus, a 2,4-dimethyloxazolium nucleus, and a 2-methyl-4,5-diphenyloxazolium nucleus; (17) a naphthooxazolium nucleus including an α-naphthooxazolium nucleus, a 2-methyl-β,β-naphthooxazolium nucleus, and a 7-hydroxy-2-methyl-p-naphthooxazolium nucleus; (18) a benzoxazolium nucleus including a benzoxazolium nucleus, a 5-chloro-2-methylbenzoxazolium nucleus, a 2,5-dimethylbenzoxazolium nucleus, a 5-chloro-2-methylbenzoxazolium nucleus, and a 6-hydroxy-2-methylbenzoxazolium nucleus; and (19) a naphthopyridinium nucleus including a 2-methylnaphtho[2,3-β]pyridinium.

Preferably, the heterocyclic ring completed via Z is a quinolinium nucleus, a benzothiazolium nucleus, a benzimidazolium nucleus, a pyridinium nucleus, an acridium nucleus, a phenanthridinium nucleus, a naphthopyridinium nucleus, or an isoquinolinium nucleus, more preferably a quinolinium nucleus, a benzothiazolium nucleus, a naphthopyridinium nucleus or a benzimidazolium nucleus, and most preferably a quinolinium nucleus.

The aliphatic group represented by $R^1$, $R^2$, $R^3$ and $R^4$ includes an unsubstituted alkyl group having 1 to 18 carbon atoms (e.g., a methyl group, an ethyl group, an isopropyl group and a hexadecyl group) and a substituted alkyl group having 1 to 18 carbon atoms in the alkyl moiety.

Examples of the substituents for the substituted alkyl group are the substituents mentioned for Z, such as a sulfoalkyl group (e.g., a 2-sulfoethyl group, a 3-sulfopropyl group, and a 4-sulfobutyl group), a carboxyalkyl group (e.g., a 2-carboxyethyl group), a hydroxyalkyl group (e.g., a 2-hydroxyethyl group), an alkoxyalkyl group (e.g., a 2-methoxyethyl group, a 2-hydroxyethoxymethyl group, and a 2-methoxyethoxy group), an acyloxyalkyl group (e.g., a 2-acetoxyethyl group), a dialkylaminoalkyl group (e.g., a 2-dimethylaminoethyl group), an aralkyl group (e.g., a benzyl group), an alkenyl group (e.g., an allyl group), and an alkynyl group (e.g., an ethynyl group, a propargyl group, a 3-butynyl group, a 2-butynyl group, a 4-pentynyl group, a 3-butyn-2-yl group, a 1-phenylpropargyl group, and a 3-phenyl-propargyl group).

Particularly preferably $R^1$ represents a propargyl group.

The aromatic group represented by $R^2$, $R^3$ and $R^4$ is one having 6 to 20 carbon atoms, such as a phenyl group and a naphthyl group, and may be substituted with one or more substituents. The substituents includes those mentioned for Z.

Specific examples of $R^2$, $R^3$ and $R^4$ include an alkyl-substituted aryl group (e.g., a 4-methylphenyl group), an aliphatic oxyaryl group (e.g., a 3-methoxyphenyl group and a 4-propargyloxyphenyl group), a hydroxyaryl group (e.g., a 4-hydroxyphenyl group), a halogen-substituted aryl group (e.g., a 4-chloro-1-naphthyl group), and a sulfoaryl group (e.g., a 4-sulfophenyl group).

Alkynyl-substituted groups possessed by any one of substituents on $R^1$, $R^2$, $R^3$, $R^4$ or Z have already been described in part and include those having 2 to 18 carbon atoms, such as an ethyl group, a propargyl group, a 2-butynyl group, a 1-methylpropargyl group, a 1,1-dimethylpropargyl group, a 3-butynyl group and a 4-pentynyl group.

These may be substituted by the substituents for Z, such as by a 3-phenylpropargyl group, a 3-methoxycarbonylpropargyl group or a 4-methoxy-2-butynyl group.

Of these, as an alkynyl group, a propargyl group is preferable.

Preferable examples of groups for accelerating adsorption on a silver halide represented by X are a thioamide group, a mercapto group and a 5- to 6-membered nitrogen-containing heterocyclic group.

The thioamide adsorption accelerating group represented by X is a divalent group represented by $$-\overset{\overset{\displaystyle S}{\|}}{C}-\text{amino}-$$

which may be part of a ring structure, or more preferably may be a non-cyclic thioamide group. Useful thioamide adsorption accelerating groups can be selected from the groups disclosed, for example, in U.S. Pat. Nos. 4,030,925, 4,031,127, 4,080,207, 4,245,037, 4,255,511, 4,266,013, and 4,276,364 and *Research Disclosure*, Vol. 151 (November, 1976), section 15162, and Vol. 176 (December, 1978), section 17626.

Particularly preferable thioamide groups are those represented by formula (II)

$$R-E-\overset{\overset{\displaystyle S}{\|}}{C}-E- \qquad \text{(II)}$$

wherein one of E and E′ represents —N($R^6$)—, the other represents —O—, —S— or —N($R^7$)—, $R^5$ represents a hydrogen atom, an aliphatic group or an aromatic group, or combines with E or E′ to form a 5- or 6-membered heterocyclic ring, and $R^6$ and $R^7$ each represents a hydrogen atom, an aliphatic group or an aromatic group.

The thioamide group represented by formula (II) includes groups derived from thiourea, thiourethane, dithiocarbamates, etc. Examples of rings formed via E or E′ and $R^5$ are ones which are considered to be the acid nucleus of a merocyanine dyes, such as 4-thiazoline-2-thion, thiazolidine-2-thion, 4-oxazoline-2-thion, oxazolidine-2-thion, 2-pyrazoline-5-thion, 4-imidazoline-2-thion, 2-thiohydantoin, rhodanine, isorhodanine, 2-thio-2,4-oxazolinedione, thiobarbituric acid, tetrazoline-5-thion, 1,2,4-triazoline-3-thion, 1,3,4-thiadiazoline-2-thion, 1,3,4-oxadiazoline-2-thion, benzimidazoline-2-thion, benzoxazoline-2-thion, and benzthiazoline-2-thion, which may be substituted with substituents such as groups explained as the substituents for Z.

As a mercapto adsorption accelerating group represented by X in the case wherein the SH group links directly to $R^1$, $R^2$, $R^3$, $R^4$ or Z or links to the substituent of $R^1$, $R^2$, $R^3$, $R^4$ or Z, can be mentioned an aliphatic mercapto group, an aromatic mercapto group or a heterocyclic mercapto group (already mentioned as a ring forming thioamide group, that is, a tautomer, in the case wherein a nitrogen atom is located next to the carbon atom linking to the SH group). The aliphatic mercapto group includes, for example, a mercapto alkyl group (e.g., a mercaptoethyl group and a mercaptopropyl group), a mercaptoalkenyl group (e.g., a mercaptopropenyl group), and a mercaptoalkynyl group (e.g., a mercaptobutynyl group). The aromatic mercapto group includes, for example, a mercaptophenyl group and a mercaptonaphthyl group. Examples of the heterocyclic mercapto group are those mentioned in the case of a ring forming thioamide group as well as a 4-mercaptopyridyl group, a 5-mercaptoquinolinyl group, and a 6-mercaptobenzothiazolyl group.

A 5- to 6-membered nitrogen-containing heterocyclic adsorption accelerating group represented by X includes a 5-to 6-membered nitrogen-containing heterocyclic ring made up of a combination of nitrogen, oxygen, sulfur and carbon. Of these, preferable ones are benzotriazole, triazole, tetrazole, indazole, benzimidazole, imidazole, benzothiazole, thiazole, benzoxazole, oxazole, thiadiazole, oxadiazole, triazine, etc., which may have a suitable substituent, for example, the substituents mentioned for Z. More preferable nitrogen-containing heterocyclic rings are benzotriazole, triazole, tetrazole, and indazole, with benzotriazole most preferable.

Preferable specific examples of nitrogen-containing heterocyclic rings are benzotriazol-5-yl, 6-chlorobenzotriazol-5-yl, benztriazole-5-carbonyl, 5-phenyl-1,3,4-triazol-2-yl, 4-(5-methyl-1,3,4-triazol-2-yl)benzoyl, 1H-tetrazol-5-yl and 3-cyanoindazol-5-yl.

A divalent linking group represented by L in general formula (I) includes an atom or an atomic group comprising at least one of C, N, S, and O. Specifically, L represents, for example, an alkylene group, an alkenylene gorup, an alkynylene group, an arylene group, —O—, —S—, —NH—, —N=, —CO—, —$SO_2$—, which may have a substituent such as a groups explained as the substituents for Z. and may be combined.

More specifically, L represents, for example, (1) an alkylene group (preferably one having 1 to 12 carbon atoms, such as a methylene group, an ethylene group, and a trimethylene group), (2) an alkenylene group (preferably one having 2 to 12 carbon atoms, such as vinylene group and a butenylene group), (3) an alkynylene group (preferably one having 2 to 12 carbon atoms, such as an ethylene group and a butynylene group), (4) an arylene group (preferably one having 6 to 10 carbon atoms, such as a phenylene group and a naphthylene group), (5) —O—, (6) —S—, (7) —NH—, (8) —N=, (9) —C—, and (10) —$SO_2$—. Examples of combinations of these are $$-O-\overset{O}{\overset{\|}{C}}-, \quad (11)$$

$$-NH-\overset{O}{\overset{\|}{C}}-, \quad (12)$$

$$-NHSO_2-, \quad (13)$$

$$-O-\overset{O}{\overset{\|}{C}}NH-, \quad (14)$$

$$-NH\overset{O}{\overset{\|}{C}}NH-, \quad (15)$$

—$NHSO_2NH$— and suitable combinations of (1) to (4) with (5) to (16) (e.g., $$-(\text{alkylene})-\overset{O}{\overset{\|}{C}}NH-,$$

$$-(\text{arylene})-SO_2NH-,$$

$$-(\text{arylene})-NH\overset{O}{\overset{\|}{C}}NH-,$$

etc.

A charge balance counter ion represented by Y is any anion that can cancel the positive electric charge produced by the quaternary ammonium salt in the heterocyclic ring.

Examples of monovalent anions are a bromine ion, a chlorine ion, an iodine ion, a p-toluenesulfonic acid ion, an ethylsulfonic acid ion, a perchloric acid ion, a trifluoromethanesulfonic acid ion, a thiocyan ion, and a picric acid ion, in which case n is 1.

Examples of divalent anions are a sulfuric acid ion, an oxalic acid ion, and a benzenedisulfonic acid ion, in which case n is $\frac{1}{2}$.

If the heterocyclic ring quaternary ammonium salt includes an anion substituent such as a sulfoalkyl substituent, the salt may be in the form of a betaine, in which case a counter ion is not required and n is 0.

If the heterocyclic ring quaternary ammonium salt has two anion substituents, for example two sulfoalkyl groups, Y represents a cationic counter ion such as an alkali metal ion (e.g., a sodium ion and a potassium ion) or an ammonium salt (e.g., triethylammonium).

Specific examples of compounds useful in the present invention are given below, but the present invention is not limited to these compounds.

(1)

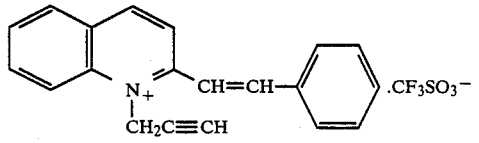

(2)

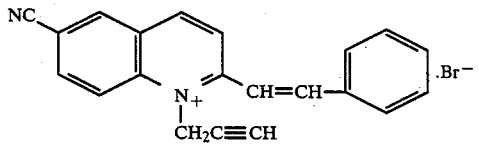

(3)

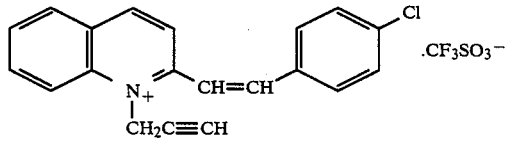

(4)

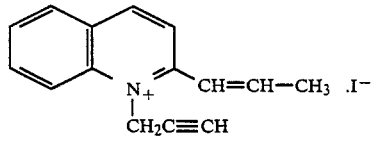

-continued
(5)
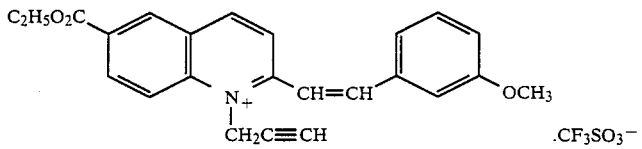
(6)
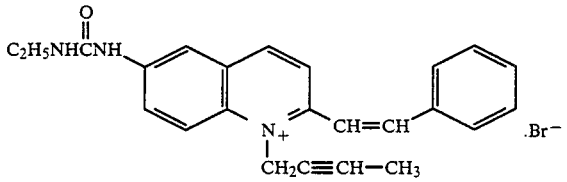
(7)
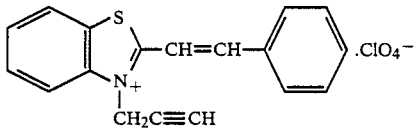
(8)
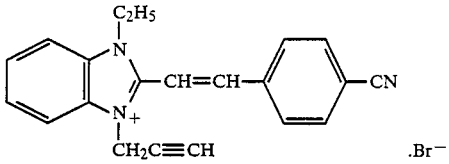
(9)
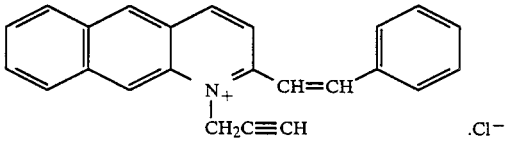
(10)
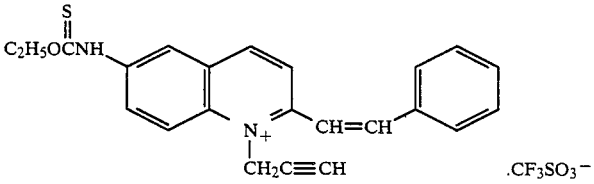
(11)
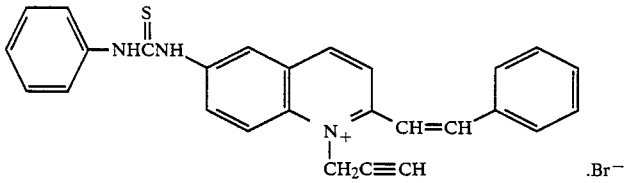
(12)
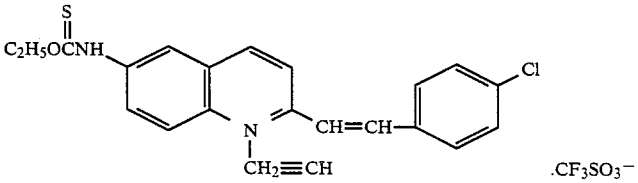
(13)
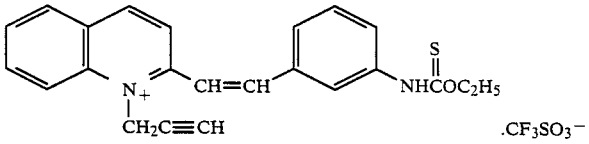

-continued
(14)
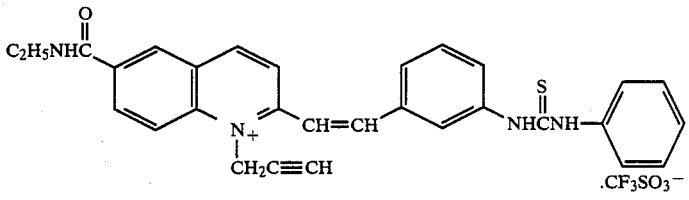
(15)
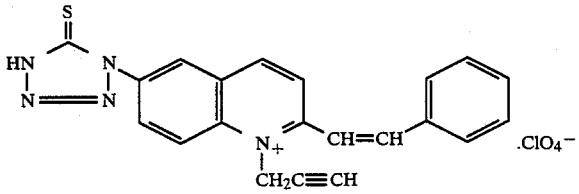
(16)
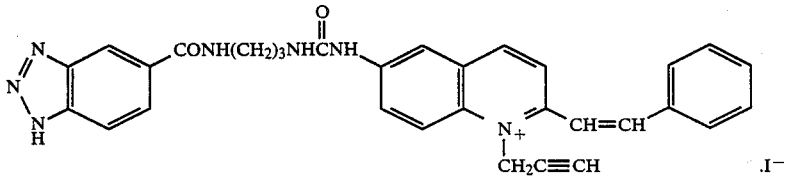
(17)
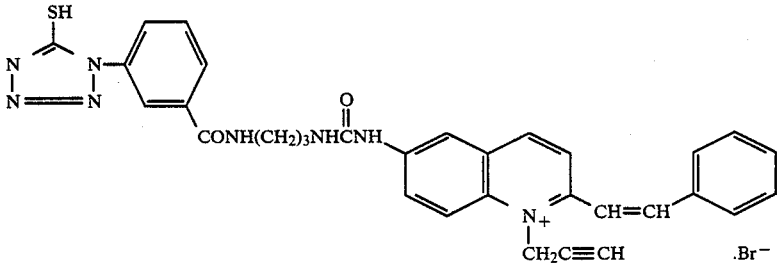
(18)
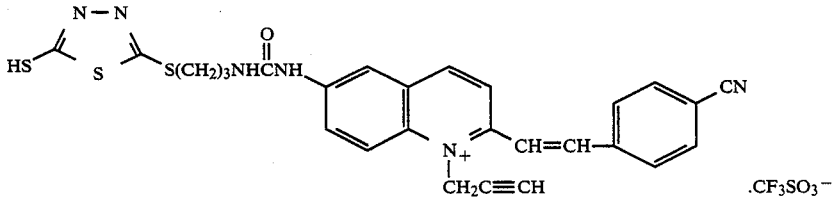
(19)
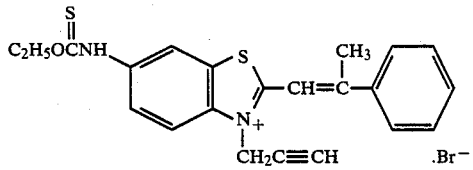
(20)
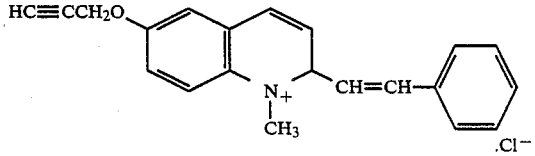
(21)
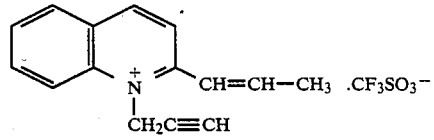

-continued (22)

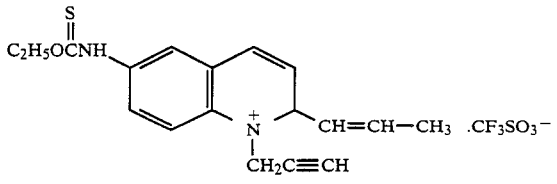

(23)

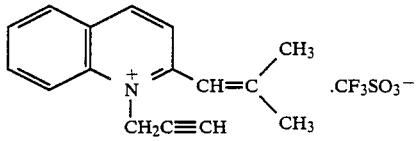

(24)

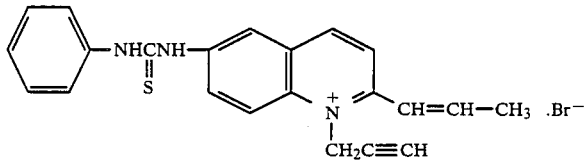

(25)

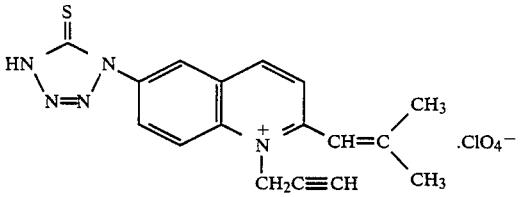

(26)

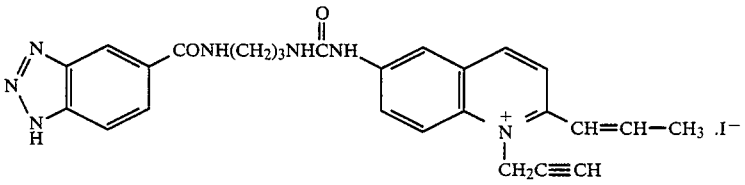

(27)

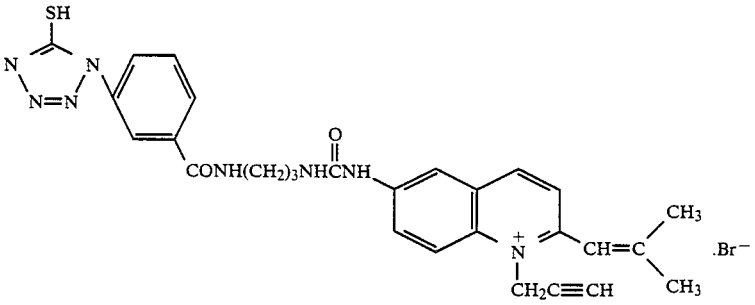

The compounds according to the invention can be synthesized in the following manner.

The introduction of the ethylene group can be attained by reacting a hetero ring having a methyl group or a substituted methyl group on the carbon atom adjacent to the hetero ring nitrogen with an aldehyde or a ketone derivative in acetic anhydride.

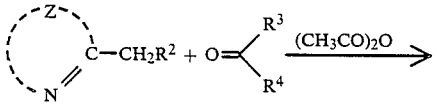

-continued

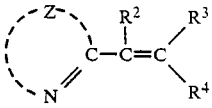

Then the quaternization of

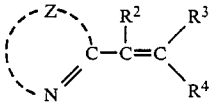

by $R^1$-Y is effected by carrying out the reaction at a temperature from room temperature to 150° C. without a solvent or in a solvent such as a hydrocarbon (e.g., toluene and xylene), a halogenated hydrocarbon (e.g., chloroform, carbon tetrachloride, 1,2-dichloroethane, and 1,1,2,2-tetrachloroethane) or an ether (e.g., tetrahydrofuran and anisole). The crystals of the reaction product are deposited by adding a bad solvent such as ethyl acetate or acetone and are separated by filtering. If the crystallizability is poor, by salt-changing the counter ion Y to another counter ion crystallizaton can be effected in many cases.

After

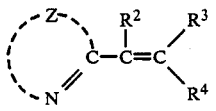

is quaternized by $R^1$-Y, the introduction of the group X for accelerating the adsorption onto a silver halide is effected by a linking group L.

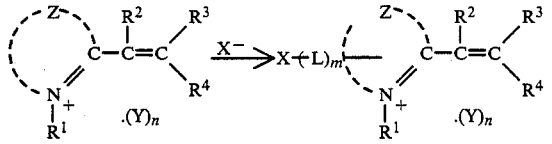

(m = 0 or 1)

As specific synthetic processes can be mentioned processes described, for example, in U.S. Pat. Nos. 4,471,044 and 4,115,122. In the above reaction formula, L is a divalent linking group and when L is changed to a different linking group, the reaction conditions also become different.

When L is, for example, a carbonamide, the introduction can be effected by carrying out the reaction of a carboxylic acid chloride or a carboxylic acid phenyl ester derivative with an amine derivative in the presence of a deoxidizer such as pyridine or triethylamine in an usual manner. Also the introduction can be effected by the reaction of a carboxylic acid derivative with an amine derivative in the presence of a condensation agent such as dicyclohexylcarbodiimide.

When L is, for example, sulfonamide, the synthesis can be effected by carrying out the reaction of a sulfonic acid chloride derivative with an amine derivative in the presence of a deoxidizer such as pyridine and triethylamine in an usual manner.

When L is, for example, ureide, the synthesis can be effected by carrying out the reaction of an isocyanate or a phenylurethane derivative with an amine derivative.

When L is, for example, an ether, the synthesis can be effected by carrying out the reaction of an alcohol derivative with a halide derivative in the presence of an alkali such as potassium carbonate, sodium hydride and potassium t-butoxide.

When L is, for example, an imine, the synthesis can be effected by carrying out the reaction of an amine derivative with a carbonyl derivative (e.g., an aldehyde or a ketone derivative) in the presence of an acid catalyst such as hydrochloric acid or sulfuric acid in an usual manner.

Other linking groups as L can be introduced in an usual manner.

Specific examples of the synthesis of the compounds according to the invention are described below.

SYNTHESIS EXAMPLE 1

Synthesis of Compound (1) (1-1) Synthesis of 2-styrylquinoline

After 7.2 g of quinaldine, 5.3 g of benzaldehyde and 5.1 g of acetic anhydride were mixed and were heated under reflux for 15 hours, the unreacted materials were distilled off by blowing steam into the mixture. The residual solid was added to a mixture of 50 ml of water and 5 ml of hydrochloric acid, and after the mixture was stirred, the resulting hydrochloride of 2-styrylquinoline was filtered.

The thus produced crystals were added to 130 ml of water, were heated to be dissolved therein, and the undissolved matter was filtered off. After 6.5 g of sodium acetate were added to the filtrate and the mixture was cooled, the deposited crystals were filtered to yield 9.6 g (83% of the theoretical yield) of 2-styrylquinoline.

(1-2) Synthesis of Compound (1)

2.8 g of pyridine and 2.0 g of propargyl alcohol in 30 ml of carbon tetrachloride were added dropwise to 10 g of trifluoromethanesulfonic anhydride in 100 ml of carbon tetrachloride while keeping the temperature at or below 0° C. by cooling with a mixture of ice and methanol. After the reaction was carried out for 10 minutes at room temperature, 10 g of anhydrous sodium sulfate were added, and the solid was filtered to obtain solution A.

Solution A was added to a mixture of 7.0 g of 2-styrylquinoline and 120 ml of carbon tetrachloride followed by heating for 3 hours under reflux. The deposited crystals were filtered, and then were recrystallized from acetonitrile to yield 5.5 g (44% of the theoretical yield) of Compound (1), melting point: 196° to 197° C.

SYNTHESIS EXAMPLE 2

Synthesis of Compound (10) (2-1) 6-nitro-2-styrylquinoline 37.6 g of 6-nitro-2-styrylquinoline-6-nitroquinaldine, 21.2 g of benzaldehyde and 20.4 g of acetic anhydride were mixed and heated for 5 hours under reflux. After the reaction mixture was allowed to cool, 100 ml of ethyl acetate were added thereto and the deposited crystals were filtered. 41.6 g (75% of the theoretical yield) of the 6-nitro-2-styrylquinoline crystals were produced.

(2-2) 6-amino-2-styrylquinoline 41.6 g of 6-nitro-2-styrylquinoline were added in portions to a mixture containing 69 g of reduced iron, 6.9 g of aluminum chloride, 450 ml of dioxane, and 90 ml of water with heating under reflux. After heating under reflux for a further 5 hours, the solid was filtered using a Nutsche filter in which sellaite is laid. The filtrate was condensed, 130 ml of ethyl acetate were added thereto, and the deposited crystals were filtered. 28 g (74% of the theoretical yield) of the 6 -amino-2-styrylquinoline crystals were produced.

(2-3) 6-isothiocyanato-2-styrylquinoline

A solution of 24.6 g of 6-amino-2-styrylquinoline and 22.3 g of triethylamine in 100 ml of N,N-dimethylacetamide was added dropwise to 12.5 g of thiophosgene in 25 ml of acetonitrile with the temperature kept at or below −10° C. using a dry ice bath. After reacting for 5 hours at room temperature, the solid was filtered off and 500 ml of chloroform were added to the filtrate. The deposited solid was filtered off and the filtrate was separated and purified by silica gel column chromatography (the developing solution: chloroform). The obtained solid was recrystallized by using ethyl acetate to yield 19.3 g (67% of the theoretical yield) of 6-isothiocyanato-2-styrylquinoline.

(2-4) Synthesis of Compound (10)

Solution A obtained in the same manner as that for Synthesis Example (1-2) was added to a solution of 8.7 g of 6-isothiocyanato-2-styrylquinoline in 120 ml of chloroform and was heated for 3 hours under reflux. After the mixture was allowed to cool, the deposited crystals were filtered, 300 ml of ethanol were added to the crystals, and the mixture was heated for 5 hours under reflux. The deposited crystals were filtered and the crystals were recrystallized from ethanol to produce 5.0 g (32% of the theoretical yield) of Compound (10), melting point: 196° to 200° C.

In the present invention, when the compound represented by general formula (I) is to be incorporated into a photographic material, the compound is dissolved in an organic solvent miscible with water such as an alcohol (e.g., methanol and ethanol), an ester (e.g., ethyl acetate) and a ketone (e.g., acetone) or in an aqueous solution if the compound is soluble in water, and the solution is added to a hydrophilic colloid solution.

When the compound represented by general formula (I) is to be added to a photographic emulsion, although the addition may be made at any time from the beginning of chemical ripening to before application to a photographic substrate, it is preferable to add the compound after chemical ripening.

In the present invention, although the nucleating agent represented by general formula (I) may be contained in a hydrophilic colloid layer adjacent to a silver halide emulsion layer, it is preferable that the nucleating agent is contained in a silver halide emulsion layer. Although the amount of the nucleating agent is varied in a wide range depending on the properties of the silver halide emulsion used in practice, the chemical structure of the nucleating agent and the development conditions, a practical amount of the nucleating agent in the silver halide emulsion is in the range of from about $1\times10^{-8}$ mol to about $1\times10^{-2}$ mol, preferably from about $1\times10^{-7}$ mol to about $1\times10^{-3}$ mol, per mol of silver.

In the case of a negative type emulsion, the amount of the nucleating agent is preferably $1\times10^{-5}$ to $1\times10^{-3}$ mol per mol of silver.

The internal latent image type silver halide emulsion that has not been previously fogged and is used in the present invention is an emulsion containing a silver halide, wherein the surface of the silver halide grains has not been previously fogged and a latent image will be formed mainly in the inside of the grain and further specifically such a silver halide emulsion that when the silver halide emulsion is applied on a transparent base in an amount of 0.5 to 3g/m$^2$ in terms of silver, and then the emulsion is exposed to light for a fixed period of 0.01 to 10 seconds, and is developed for a period of 5 minutes at 18° C. in a developing solution A (an internal type developing solution) shown below, the maximum density measured by an usual photographic density measuring method is preferably at least 5 times, more preferably at least 10 times, as high as the maximum density obtained in the case when the silver halide emulsion is applied in the same amount as above, is exposed to light and is developed for a period of 6 minutes at 20° C. in a developing solution B (a surface type developing solution) shown below.

| An internal developing solution A | |
|---|---|
| Metol | 2 g |
| Sodium sulfite (anhydride) | 90 g |
| Hydroquinone | 8 g |
| Sodium carbonate (monohydrate) | 52.5 g |
| KBr | 5 g |
| KI | 0.5 g |
| Water to make | 1 liter |
| **A surface developing solution B** | |
| Metol | 2.5 g |
| l-ascorbic acid | 10 g |
| $NaBO_2.4H_2O$ | 35 g |
| KBr | 1 g |
| Water to make | 1 liter |

Specific examples of internal latent image type emulsions include conversion type silver halide emulsions described, for example, in U.S. Pat. No. 2,592,250, Japanese patent publication Nos. 54379/83, 3536/83 and 5582/85 and Japanese patent application (OPI) Nos. 156614/77, 79940/82 and 70221/83 and emulsions having shells attached to said conversion type silver halide emulsions, and core/shell type silver halide emulsions the inside of which is doped with a metal described in U.S. Pat. Nos. 3,761,276, 3,850,637, 3,923,513, 4,035,185, 4,395,478, 4,431,730 and 4,504,570, Japanese patent application (OPI) Nos. 6022/78, 22681/81, 208540/84, 107641/85 and 3137/86, incorporated herein by reference and hereinafter the same, and patents cited in *Research Disclosure*, No. 23510 (November, 1983), page 236 and No. 18155 (May, 1979), pages 265 to 268.

The silver halide grains used in the present invention may be regular crystals such as cubic, octahedral, dodecahedral and tetradecahedral crystals or irregular crystals such as globular crystals or tabular grains whose length/thickness ratio is 5 or more. A composite form of these crystal forms may also be used and an emulsion made up of a mixture of these crystals may also be used.

The composition of the silver halide is silver chloride, silver bromide or a mixed silver halide and a silver halide preferably used in the present invention is free from silver iodide or if it contains silver iodide, it is silver bromo(iodo)chloride, silver (iodo)chloride or silver (iodo)bromide containing 3 mol% or less of silver iodide.

The average grain size of the silver halide grains is preferably in the range from 0.1 to 2 $\mu$, more preferably in the range from 0.15 to 1 $\mu$.

Although the grain size distribution may be wide or narrow, in order to improve graininess, sharpness, etc., it is preferable in the present invention to use the so-called "monodispersed" silver halide emulsion, wherein the grain size distribution is narrow, such that 90% or more of all the grains fall within ±40%, preferably ±20%, of the average grain size in terms of grain number or weight. In order to obtain satisfactory gradation with the photosensitive material, in emulsion layers having substantially the same color sensitivity, two or more monodispersed silver halide emulsions different in grain size or a plurality of grains having the same size but different in sensitivity are mixed in the same layer or are applied as different layers that are superposed. Two or more polydispersed silver halide emulsions or a monodispersed silver halide emulsion and a polydispersed silver halide emulsion can be used in the form of a mixture or superposed layers.

In the silver halide emulsion used in the present invention, the inside or the surface of the grains may be chemically sensitized by sulfur sensitization, selenium sensitization, reduction sensitization or noble metal sensitization that can be used alone or in combination. Particular examples of chemical sensitization are described, for example, in patents cited in *Research Disclosure*, No. 17643-III (December, 1978), page 23.

The photographic emulsion used in the present invention is spectrally sensitized with a photographic sensitizing dye in an usual manner. Particularly useful dyes are cyanine dyes, merocyanine dyes and composite merocyanine dyes, which may be used alone or in combination and can be used in combination with supersensitizers. Particular examples are described, for example, in patents cited in *Research Disclosure*, No. 17643-IV (December, 1978), pages 23 to 24.

The photographic emulsion used in the present invention can contain an antifoggant or a stabilizer for the purpose of stabilizing the photographic performance or of preventing fogging during the photographic treatment, storage or production process of the photographic material. Particular examples of antifoggants and stabilizers that may be used in the present invention are described, for example, in *Research Disclosure*, No. 17643-VI (December, 1978), pages 24 to 25 and by E. J. Birr in *Stabilization of Photographic Silver Halide Emulsions* (Focal Press), 1974.

To form a direct positive color image, various color couplers can be used. Useful color couplers are compounds that can couple with the oxidized product of an aromatic primary amine type color developer to produce or release a dye that is preferably substantially non-diffusible. Typical examples of useful color couplers include naphthol or phenol type compounds, pyrazolone or pyrazoloneazole type compounds and open chain or heterocyclic ketomethylene compounds. Specific examples of these cyan, magenta and yellow couplers are compounds described in *Research Disclosure*, No. 17643 (December, 1978), page 25, section VII-D, and No. 18717 (November, 1979), and Japanese patent application (OPI) No. 215272/87 (page 298 to 373), incorporated herein by reference and hereinafter the same, and compounds described in patents cited in them.

Amongst others, as yellow couplers that can be used in the present invention can be mentioned yellow two-equivalent couplers of oxygen atom coupling off type or nitrogen atom coupling off type. Particularly, α-pivaloylacetanilide type couplers are excellent in fastness, in particular light-fastness, of the color formed dyes, while α-benzoylacetanilide type couplers are preferable because a high color density can be obtained.

5-pyrazolone type magenta couplers preferably used in the present invention are 5-pyrazolone type couplers (particularly sulfur atom coupling-off type two-equivalent couplers) whose 3-position is substituted by an arylamino group or an acylamino group.

Pyrazoloazole type couplers are further preferable, pyrazolo[5,1-c][1,2,4]triazoles described in U.S. Pat. No. 3,725,067 are particularly preferable, imidazo[1,2-b]pyrazoles described in U.S. Pat. No. 4,500,630 are more preferable in view of their fastness to light and the lower yellow side absorption of the colored dye, and pyrazolo[1,5-b][1,2,4]-triazoles described in U.S. Pat. No. 4,540,654 are most preferable.

Cyan couplers that can preferably be used in the present invention are naphthol type and phenol type couplers described, for example, in U.S. Pat. Nos. 2,474,293 and 4,052,212, and phenol type cyan couplers having an alkyl group higher than an ethyl group at the meta-position of the phenol nucleus described in U.S. Pat. No. 3,772,002, and 2,5-diacylamino-substituted phenol type couplers are also preferable in view of their dye stability.

Specific examples of particularly preferable yellow, magenta and cyan couplers are compounds listed in Japanese patent application No. 169523/86 (application by Fuji Photo Film Co., Ltd., on July 8, 1986 and corresponding to U.S. patent application Ser. No. 075,008), incorporated herein by reference and hereinafter the same, and the compounds listed below are also preferable examples.

Magenta Coupler

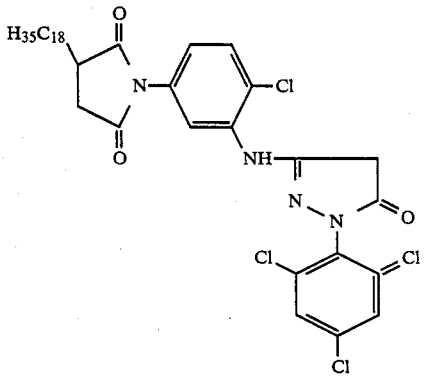

(M-12)

-continued
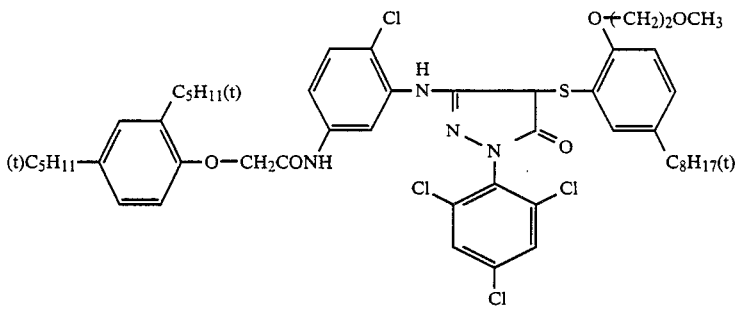
(M-13)
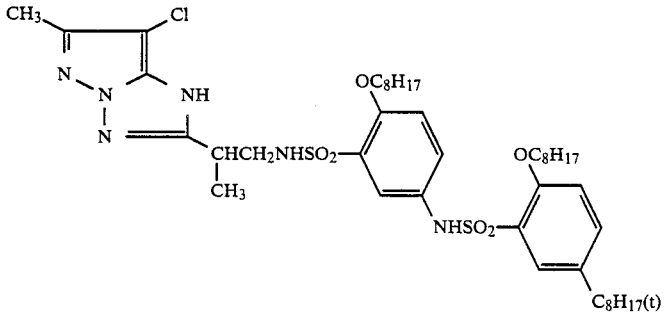
(M-14)
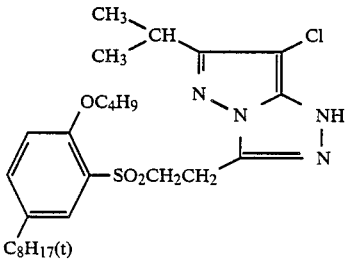
(M-15)
Yellow Coupler
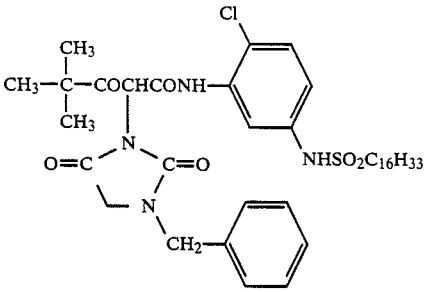
(Y-9)
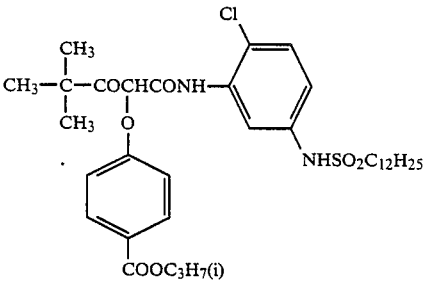
(Y-10)

-continued (Y-11)

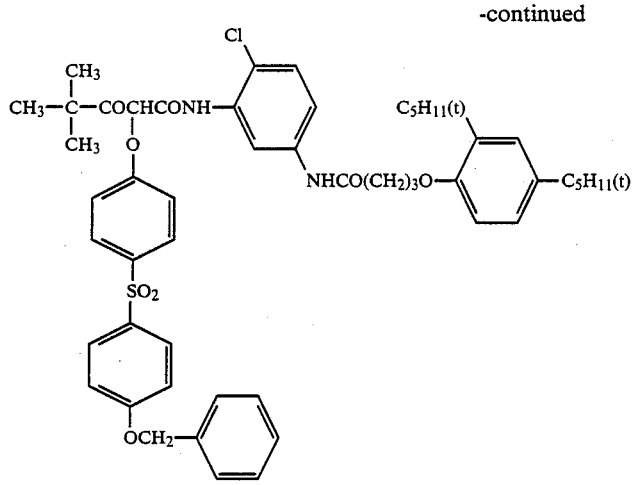

Cyan Coupler (C-10)

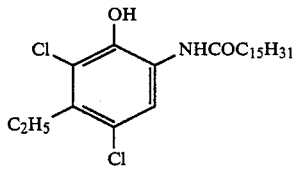

(C-11)

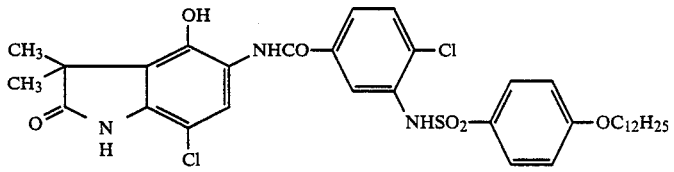

Colored couplers for correcting undesired absorption of the short wave range of the produced dyes, couplers whose color formed dyes have a suitable diffusibility, colorless couplers, DIR couplers that will release a development restrainer as a result of the coupling reaction, couplers that can release a development accelerator and polymerized couplers can also be used.

Generally, the amount of a color coupler used is in the range of 0.001 to 1 mol per mol of a photosensitive silver halide, preferably in the case of a yellow coupler the amount is 0.01 to 0.5 mol per mol of a photosensitive silver halide, in the case of a magenta coupler the amount is 0.003 to 0.3 mol per mol of a photosensitive silver halide, and in the case of a cyan coupler the amount is 0.02 to 0.5 mol per mol of a photosensitive silver halide.

Photosensitive materials prepared in accordance with the present invention may contain, as a color fogging preventing agent or color mixing preventing agent, hydroquinone derivatives, aminophenol derivatives, amines, gallic acid derivatives, catechol derivatives, ascorbic acid derivatives, colorless couplers, sulfonamidophenol derivatives, etc. Typical examples of color fogging preventing agents and color mixing preventing agents are described in Japanese patent application (OPI) No. 215272/87, pages 600 to 630, incorporated herein by reference and hereinafter the same.

In the present photosensitive materials, various discoloration preventing agents can be used. As organic discoloration preventing agents can be mentioned hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and ether or ester derivatives obtained by the silylation or alkylation of the phenolic hydroxyl group of these compounds. Further, metal complexes such as (bis-salicylaldoxymato)nickel complex and (bis-N,N-dialkyldithiocarbamato)nickel complexes can be used.

For the purpose of preventing yellow dye images from being deteriorated by heat, humidity and light, compounds having both the structures of a hindered amine and a hindered phenol in a single molecule as described in U.S. Pat. No. 4,268,593 give good results. For the purpose of preventing magenta dye images from being deteriorated, particularly by heat, spiroindanes described in Japanese patent application (OPI) No. 159644/71 and chromans substituted by hydroquinone diethers or monoethers described in Japanese patent application (OPI) No. 89835/80 give good results.

Typical examples of these discoloration preventing agents are described in Japanese patent application (OPI) No. 215272/87, pages 401 to 440, incorporated herein by reference. Desirable results can be attained when these compounds are added to photosensitive layers generally in amounts of 5 to 100 wt. % for each of the respective color couplers by co-emulsifying with the couplers.

For the purpose of preventing cyan dye images from being deteriorated by heat and, particularly, light, introducing an ultraviolet absorbing agent into opposite layers adjacent to a cyan color forming layer is effective. An ultraviolet absorbing agent can also be added to a hydrophilic colloid layer such a protective layer. Typical examples of such compounds are described in Japanese patent application (OPI) No. 215272/87, pages 391 to 400.

As binding agents or protective colloids that can be used in emulsion layers and intermediate layers of the present photosensitive material, it is advantageous to use gelatin, but other hydrophilic colloids other than that one can also be used.

Dyes for preventing irradiation or halation, ultraviolet absorbing agents, plasticizers, brightening agents, matting agents, air fogging preventing agents, coating assistants, hardening agents, antistatic agents, slipperiness improvers, etc., can be added to the present photosensitive materials. Typical examples of these additives are described in *Research Disclosure*, No. 17643, sections VIII to XIII (December, 1978), pages 25 to 27 and No. 18716 (November, 1979), pages 647 to 651.

The present invention can be applied to multilayer multicolor photographic materials having at least two different spectral sensitivities on a base. Generally a multilayer natural color photographic material has at least one red sensitive emulsion layer, at least one green sensitive emulsion layer and at least one blue sensitive emulsion layer on a base. The order of these layers are arbitrarily selected as desired.

A preferable order of the layers is such that a red sensitive emulsion layer, a green sensitive emulsion layer and a blue sensitive emulsion layer are arranged from the base side or a green silver emulsion layer, a red sensitive emulsion layer and a blue sensitive emulsion layer are arranged from the base side.

Each of the emulsion layers having a particular sensitivity may be comprised of two or more emulsion layers different in sensitivity or may be comprised of two or more emulsion layers having the same sensitivity with a nonphotosensitive layer between them.

Generally, the red sensitive emulsion layer contains a cyan forming coupler, the green sensitive emulsion layer contains a magenta forming coupler and the blue sensitive emulsion layer contains a yellow forming coupler, but in some cases the combination can be changed.

It is preferable that the photosensitive material according to the present invention be provided with suitable auxiliary layers, such as a protective layer, an intermediate layer, a filter layer, a halation preventing layer, a back layer and a white reflective layer.

In the present photographic materials, the photographic emulsion layers and other layers may be applied on bases described in *Research Disclosure*, No. 17643, section XVII (December, 1978), page 28 and European Pat. No. 182,253 and Japanese patent application (OPI) No. 97655/86. Methods of coating described in *Research Disclosure*, No. 17643, section XV, pages 28 to 29 can be employed.

The present invention can be applied to various color photosensitive materials.

When the present photosensitive materials are used in color diffusion transfer processes, although a dye developing agent can be used as a coloring material, it is advantageous that the coloring material itself is alkaline (in a developing solution) and non-diffusible (nonmobile) and is of a type that can release a diffusible dye (or its precursor) as a result of the development. The diffusible dye releasing type coloring materials (DDR compounds) include redox compounds and couplers that can release a diffusible dye, which are useful not only for a color diffusion transfer processes (i.e., wet type), but also useful as a coloring material for heat development type photosensitive materials as described in Japanese patent application (OPI) No. 58543/83.

Diffusible dye releasing redox compounds (hereinafter referred to as "DRR compounds") can be represented by the following general formula:

(Ballast)(redox releasable atomic group)-D

The compounds described in Japanese patent application (OPI) No. 163938/83, pages 12 to 22, can be used for the (Ballast) and redox releasable atomic group in the formula.

D represents a dye (or its precursor) moiety, which may link to the redox releasable atomic group via a linking group. Those described in the following publications are effective for the dye moiety represented by D: Examples of yellow dyes: U.S. Pat. Nos. 3,597,200, 3,309,199, 4,013,633, 4,245,028, 4,156,609, 4,139,383, 4,195,992, 4,145,641, 4,148,643, and 4,366,322, Japanese patent application (OPI) Nos. 114930/76 and 71072/81, and *Research Disclosure*, Nos. 17630 (1978) and 16475 (1977).

Examples of magenta dyes:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and Japanese patent application (OPI) Nos. 106727/77, 23628/78, 36804/80, 73057/81, 71060/81 and 134/80.

Examples of cyan dyes:

U.S. Pat. Nos. 3,482,972, 3,929,760, 4,013,635, 4,268,625, 4,171,220, 4,242,435, 4,142,891, 4,195,994, 4,147,544 and 4,148,642, British Pat. No. 1,551,138, Japanese patent application (OPI) Nos. 99431/79, 8827/77, 47823/78, 143323/78, and 71061/81, European Pat. Nos. 53,037 and 53,040, and *Research Disclosure*, Nos. 17630 (1978) and 16475 (1977).

Generally the coating amount of these compounds is about $1\times10^{-4}$ to $1\times10^{-2}$, preferably $2\times10^{-4}$ to $2\times10^{-2}$ mol/m$^2$.

In the present invention, the coloring material may be contained in a silver halide emulsion layer associated with the coloring material, or may be contained in a layer adjacent to said emulsion layer on the side where exposure will be made or on the opposite side.

When the present photosensitive materials are used in color diffusion transfer processes, the photographic emulsion may be applied integrally on the base on which an image receiving layer is applied or may be applied on a separate base. The silver halide photographic emulsion layer (a photosensitive element) and the image receiving layer (an image receiving element) may be provided in the form of a combination as a unit or may be provided as separate independent photographic materials. The form as a film unit may be of an integrated type throughout the exposure, the development, and the appreciation of the transferred image, or may be of a type that can be released after the development, with the latter type more effective in the present invention.

The present invention can be applied to various color photographic materials.

For example, color reversal papers and color reversal films for slides and television and instant color films can be mentioned as typical examples. The present invention can also be applied to color hard copies for storing images of CRT of for full color copying machines. The present invention can also be applied to black and white photographic materials using a mixture of three color couplers described in *Research Disclosure*, No. 17123 (June, 1978).

The present photosensitive material can provide a direct positive color image by exposing it to light imagewise, and developing it with a surface developing solution containing an aromatic primary amine type color developer followed by bleaching and fixing.

For the purpose of increasing maximum image density, lowering minimum image density, improving shelf life of the photosensitive material, quickening development, and other purposes, the following compounds may be added: hydroquinones (e.g., compounds described in U.S. Pat. Nos. 3,227,552 and 4,279,987), chromans (e.g., compounds described in U.S. Pat. No. 4,268,621, Japanese patent application (OPI) No. 103031/79 and *Research Disclosure*, No. 18264 (June, 1979), pages 333 to 334), quinones (e.g., compounds described in *Research Disclosure*, No. 21206 (December, 1981), pages 433 to 434), amines (e.g., compounds described in U.S. Pat. No. 4,150,993 and Japanese patent application (OPI) No. 174757/83), oxidizing agents (e.g., compounds described in Japanese patent application (OPI) No. 260039/85 and *Research Disclosure*, No. 16936 (May, 1978), pages 10 to 11), catechols (e.g., compounds described in Japanese patent application (OPI) Nos. 21013/80 and 65944/80), compounds that will release a nucleating agent at the time of development (e.g., compounds described in Japanese patent application (OPI) No. 107029/85), thioureas (e.g., compounds described in Japanese patent application (OPI) No. 95533/85) and spirobisindanes (e.g., compounds described in Japanese patent application (OPI) No. 65944/80).

Nucleation accelerators that can be used in the present invention include pentaazaindenes, triazaindenes and tetraazaindenes having at least one mercapto group that is optionally substituted by an alkali metal atom or ammonium group and compounds described in Japanese patent application (OPI) No. 136948/86 (pages 2 to 6 and 6 to 43), and Japanese patent application No. 136949/86 (corresponding to U.S. patent application Ser. No. 060,790), pages 12 to 43, incorporated herein by reference.

Specific examples of nucleation accelerators that can be used in the present invention are given below, but the present invention is not limited to the photographic materials using these compounds.

(A-1): 3-mercapto-1,2,4-triazolo[4,5-a]pyridine
(A-2): 3-mercapto-1,2,4-triazolo[4,5-a]pyrimidine
(A-3): 5-mercapto-1,2,4-triazolo[1,5-a]pyrimidine
(A-4): 7-(2-dimethylaminoethyl)-5-mercapto-1,2,4-triazolo[1,5-a]pyrimidine
(A-5): 3-mercapto-7-methyl-1,2,4-triazolo[4,5-a]pyrimidine
(A-6): 3,6-dimercapto-1,2,4-triazolo[4,5-b]pyridadine
(A-7): 2-mercapto-5-methylthio-1,3,4-thiadiazole
(A-8): 3-mercapto-4-methyl-1,2,4-thiazole
(A-9): 2-(3-dimethylaminopropylthio)-5-mercapto-1,3,4-thiadiazole hydrochloride
(A-10): 2-(2-morpholinoethylthio)-5-mercapto-1,3,4-thiadiazole hydrochloride
(A-11): 2-mercapto-5-methylthiomethylthio-1,3,4-thiadiazole sodium salt
(A-12): 4-(2-morpholinoethyl)-3-mercapto-1,2,4-triazole
(A-13): 2-[2-(2-dimethylaminoethylthio)ethylthio]-5-mercapto-1,3,4-thiadiazole hydrochloride It is preferable that the nucleation accelerator be added to a silver halide emulsion or a layer adjacent thereto.

The amount of nucleation accelerator to be added is preferably $10^{-6}$ to $10^{-2}$ mol, more preferably $10^{-5}$ to $10^{-2}$ mol, per mol of a silver halide.

If the nucleation accelerator is to be added to a processing solution, i.e., a developing solution or a bath prior to a processing solution, the amount of the nucleation accelerator is $10^{-8}$ to $10^{-3}$ mol, preferably $10^{-7}$ to $10^{-4}$ mol, per liter of the processing solution.

Two or more nucleation accelerators can be used.

The color developing solution used for developing the present photosensitive material is substantially free from a silver halide solvent and is preferably an alkaline solution whose major component is an aromatic primary amine color developing agent.

As the color developing agent, aminophenol type compounds are useful and p-phenylenediamine type compounds are preferable. Typical examples thereof are 3-methyl-4-amino-N-ethyl-N-(β-methanesulfonamidoethyl)aniline, 3-methyl-4-amino-N-ethyl-N-(β-hydroxyethyl)aniline and 3-methyl-4-amino-N-ethyl-N-methoxyethylaniline and their sulfates and hydrochlorides. Compounds described by L. F. A. Mason in *Photographic Processing Chemistry*, Focal Press (1966), pages 226 to 229, in U.S. Pat. Nos. 2,193,015 and 2,592,364 and Japanese patent application (OPI) No. 64933/73 can also be used.

If desired, two or more color developing agents can be used in combination.

The amount of color developing agent to be used is preferably 0.1 to 20 g, more preferably 0.5 to 15 g, per liter of the developing solution.

As preservatives, aromatic polyhydroxy compounds described in Japanese patent application (OPI) Nos. 49828/77, 47038/81, 32140/81 and 160142/84 and U.S. Pat. No. 3,746,544; hydroxyacetones described in U.S. Pat. No. 3,615,503 and British Pat. No. 1,306,176; α-aminocarbonyl compounds described in Japanese patent application (OPI) Nos. 143020/77 and 89425/78; metals described, for example, in Japanese patent application (OPI) Nos. 44148/82 and 53749/82; sugars described in Japanese patent application (OPI) No. 102727/77; hydroxamic acids described in Japanese patent application (OPI) No. 27638/77; α,α'-dicarbonyl compounds described in Japanese patent application (OPI) No. 160141/84; salicylic acids described in Japanese patent application (OPI) No. 180588/84; alkanolamines described in Japanese patent application (OPI) No. 3532/79; poly(alkyleneimines) described in Japanese patent application (OPI) No. 95349/81; and gluconic acid derivatives described in Japanese patent application (OPI) No. 75647/81 can, for example, be mentioned, which may be used in combination if required.

Particularly, the addition of 4,5-dihydroxy-m-benzenedisulfonic acid, poly(ethyleneimine) and triethanolamine is preferable. The addition of substituted phenols such as p-nitrophenol is also preferable. The use of alkylhydroxylamine compounds described in Japanese patent application (OPI) No. 3532/79 is also preferable.

It is particularly preferable that alkylhydroxylamine compounds are used in combination with the above-mentioned preferred preservatives.

The amount of preservative to be used may be 0.1 to 20 g and is preferably 0.5 to 10 g per liter of the developing solution.

The pH of the color developing solution in the present invention is preferably up to 11.5, more preferably 9.5 to 11.2, and most preferably 9.8 to 11.0.

To maintain the pH mentioned above, various buffers can be used. As a buffer, carbonates such as potassium carbonate, phosphates such as potassium phosphate and compounds described in Japanese patent application No. 215272/87, pages 11 to 22, incorporated herein by reference, can be used.

The color developing solution can contain various chelating agents as agents for preventing calcium and magnesium from precipitating or for improving the stability of the color developing solution.

As examples of chelating agents, aminopolycarboxylic acids described in Japanese Patent Publication Nos. 30496/73 and 30232/69, organic phosphonic acids described in Japanese patent application (OPI) No. 97347/81, Japanese Patent Publication No. 39359/81 and West German Pat. No. 2,227,639, phosphonocarboxylic acids described in Japanese patent application (OPI) Nos. 102726/77, 42730/78, 121127/79, 126241/80 and 65956/80 and other compounds described in Japanese patent application (OPI) Nos. 195854/83 and 203440/83 and Japanese Patent Publication No. 40900/78 can be mentioned, which can be used in combination if required.

The amount of the chelating agent or agents to be added is the amount which is sufficient to sequester metal ions present in the color developing solution. For example, the amount may be on the order of 0.1 to 10 g per liter.

If desired, an arbitrary development accelerator can be added to the color developing solution.

As development accelerators, thioether type compounds described, for example, in Japanese Patent Publication Nos. 16088/62, 5987/62, 7826/63, 12380/69 and 9019/70 and U.S. Pat. No. 3,813,247; p-phenylenediamine type compounds described in Japanese patent application (OPI) Nos. 49829/77 and 15554/75; quaternary ammonium salts described, for example, in Japanese patent application (OPI) No. 137726/75, Japanese Patent Publication No. 30074/69 and Japanese patent application (OPI) Nos. 156826/81 and 43429/77; p-aminophenols described in U.S. Pat. Nos. 2,610,122 and 4,119,462; amine type compounds described, for example, in U.S. Pat. Nos. 2,494,903, 3,128,182, 4,230,796 and 3,253,919, Japanese Patent Publication No. 11431/66, U.S. Pat. Nos. 2,482,546, 2,596,926 and 3,582,346; and 1-phenyl-3-pyrazolidones, hydrazines, meso-ionic compounds, thionic compounds, imidazoles and polyalkylene oxides described, for example, in Japanese Patent Publication Nos. 16088/62 and 25201/67, U.S. Pat. No. 3,128,183, Japanese Patent Publication Nos. 11431/66 and 23883/67 and U.S. Pat. No. 3,532,501 can be mentioned.

Thioether type compounds and 1-phenyl-3-pyrazolidones are particularly preferable.

If required, an arbitrary antifoggant can be added to the color developing solution in the present invention.

As an antifoggant, an alkali metal halide such as potassium bromide, sodium chloride and potassium iodide or an organic antifoggant can be used.

As an organic antifoggant, a nitrogen-containing heterocyclic ring compound such as benzotriazole, 6-nitrobenzimidazole, 5 -nitroisoindazole, 5-methylbenzotriazole, 5-nitrobenzotriazole, 5-chloro-benzotriazole, 2-thiazolylbenzimidazole, 2-thiazolylmethyl-benzimidazole and hydroxyazaindolizine; a mercapto-substituted heterocyclic compound such as 2-mercaptobenzimidazole and 2-mercaptobenzthiazole; and a mercapto-substituted aromatic compound such as thiosalicylic acid and adenine can, for example, be used.

Although the above-mentioned antifoggants may dissolve out of the color photosensitive material during processing and may accumulate in the color developing solution, it is preferable that the amount of antifoggant accumulation be less in view of the importance of reducing the amount of discharge amount of the developer.

It is preferable that the color developing solution in the present invention contain a brightening agent. It is preferable to use, as a brightening agent, a 4,4-diamino-2,2'-disulfostilbene type compound. The amount of brightening agent to be added may be from 0 to 5 g/liter, preferably 0.1 to 2 g/liter.

If required, surface active agents may be added such as alkylphosphonic acids, arylphosphonic acids, aliphatic carboxylic acids and aromatic carboxylic acids.

Generally, the photographic emulsion layer after the color development is bleached. The bleaching may be carried out simultaneously with fixing in a one bath bleach-fixing step or the bleaching and the fixing can be carried out separately.

To quicken processing, bleach-fix either after bleaching or after fixing can be effected.

Generally, the bleaching solution or the bleach-fix solution in the present invention uses, as a bleaching agent, an aminopolycarboxylic acid iron complex salt.

As additives to be used in the bleaching solution or the bleach-fix solution in the present invention, various compounds described in Japanese patent application (OPI) No. 215272/87, pages 22 to 30, incorporated herein by reference, can be used.

After desilvering (bleach-fix or bleaching), washing and/or stabilizing is carried out. It is preferable to use water that has been subjected to a water softening treatment for washing or for a stabilizing solution. As a method of softening water, using an ion exchange resin or a reverse osmosis apparatus described in Japanese patent application No. 131632/86, incorporated herein by reference, can be used. More specifically, the water softening method described in Japanese patent application No. 131632/86, incorporated herein by reference, is preferred.

Further, as additives that may be used in a washing step and in a stabilizing step can be mentioned various compounds described in Japanese patent application (OPI) No. 215272/87, pages 30 to 36, incorporated herein by reference.

It is preferable that the amount of replenishing solution for each step is small. Preferably the amount of replenishing solution is 0.1 to 50 times, more preferably 3 to 30 times, the amount of the solution carried over from the preceding bath per unit area of the photosensitive material.

If DRR compounds are used in the present invention, any silver halide developers (or electron donating agents) that can be cross-oxidized can be used.

Such a developing solution can be contained in an alkaline development processing solution (a processing element) or in a suitable layer in the photographic element. Examples of developers that can be used in the present invention include hydroquinone, aminophenols such as N-methylaminophenol, 1-phenyl-3-pyrazolidinone, 1-phenyl-4,4-dimethyl-3-pyrazolidinone, 1-phenyl-4-methyl-4-oxymethyl-3-pyrazolidinone, N,N-diethyl-p-phenylenediamine, 3-methyl-N,N-diethyl-p-phenylenediamine, and 3-methoxy-N-ethoxy-p-phenylenediamine.

Of these, generally, black and white developing agents having the property of reducing stain formation in an image receiving layer (a mordant layer) are most preferable as in the case of the above-mentioned alkaline development processing solutions.

When the present photosensitive materials are used in film units for diffusion transfer processes, it is preferable that they are processed with a viscous developing solution. The viscous developing solution is a liquid composition containing processing components required for the development of the silver halide emulsion (and the formation of a diffusion transfer dye image), the major component of the liquid composition is water, and the liquid composition contains, in some cases, a hydrophilic solvent such as a methanol and methyl cellosolve.

Preferably, the processing composition contains a hydrophilic polymer such as a high-molecular weight polyvinyl alcohol, hydroxyethyl cellulose and sodium carboxymethylcellulose. It is preferable that these polymers are used in such an amount that allow the processing composition to have a viscosity in the order of 1 poise or more, preferably 500 to 1000 poises, at room temperature.

It is preferable to use such a processing composition by loading it into containers that can be broken by pressure as described in U.S. Pat. Nos. 2,543,181, 2,643,886, 2,653,732, 2,723,051, 3,056,491, 3,056,492, and 3,152,515.

The present invention is further described in the Examples below, but is not to be considered limited by these Examples. Unless specified otherwise, all parts, percents and ratios are by weight.

EXAMPLE 1

An internal latent image type direct positive silver bromide emulsion was prepared wherein the inside of the grains was chemically sensitized with sulfur and gold and the surface of the grains was chemically sensitized with sulfur in the same manner as that described in Japanese patent application (OPI) No. 95533/85. The emulsion grains were octahedrons having a size of 1.0 μm. A nucleating agent according to the present invention or a nucleating agent for comparison disclosed in U.S. Pat. No. 4,471,044 was added to the emulsion, and the emulsion was applied together with a protective layer (gelatin 0.8 g/m$^2$) on a cellulose acetate film base in such proportions that the amount of silver was 4.4 g/m$^2$ and the amount of gelatin was 4.9 g/m$^2$.

The thus coated samples were exposed to tungsten light of 1000 luxes for 1/10 second through a continuous tone wedge, and was processed with developing solution X (a surface developing solution, the pH=13.5) having the composition given below. The maximum density (Dmax) and the minimum (Dmin) of each of the obtained direct reversal images are given in Table 1.

| Developing Solution X | |
|---|---|
| Sodium sulfite | 30 g |
| Hydroquinone | 10 g |
| 1-Phenyl-4-methyl-4-hydroxymethyl-3-pyrazolidine | 0.75 g |
| Sodium phosphate | 40 g |
| Sodium hydroxide | 10.7 g |
| 5-Methylbenzotriazole | 0.02 g |
| Water to make | 1 liter |

From Table 1, it can be seen that the compounds according to the present invention exhibit better reversing performance than Comparative Example A.

TABLE 1

| Nucleating agent | Amount added mmol/mol AgBr | $D_{max}$ | $D_{min}$ | Note |
|---|---|---|---|---|
| None | — | 0.07 | 0.07 | Comparison |
| Compound (1) | 0.005 | 1.55 | 0.07 | Invention |
| Compound (10) | 0.004 | 1.75 | 0.08 | " |
| Compound (12) | 0.004 | 1.80 | 0.08 | " |
| Compound (21) | 0.005 | 1.85 | 0.08 | " |
| Compound (22) | 0.002 | 1.87 | 0.08 | " |
| Comparative Example A | 0.004 | 1.50 | 0.12 | Comparison |

Comparative Example A

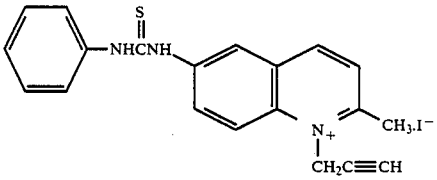

EXAMPLE 2

A nucleating agent according to the present invention or the compound of Comparative Example A mentioned above was added to the same internal latent image type direct positive emulsion as that in Example 1 to prepare each coated sample like Example 1. These coated samples were exposed imagewise under the same exposure conditions as those in Example 1, and were processed with a developing solution Y (pH=10.7) having the composition shown below. The maximum density (Dmax) and the minimum (Dmin) of each of the obtained direct reversal images are given in Table 2.

| Developing Solution Y | |
|---|---|
| Sodium sulfite | 30 g |
| Hydroquinone | 10 g |
| 1-Phenyl-4-methyl-4-hydroxymethyl-3-pyrazolidine | 0.75 g |
| Sodium phosphate | 40 g |
| 5-Methylbenzotriazole | 0.02 g |
| Water to make | 1 liter |

From Table 2, it can be seen that the compounds according to the present invention exhibit better reversing performance than Comparative Example A at a low pH.

TABLE 2

| Nucleating agent | Amount added mmol/mol AgBr | $D_{max}$ | $D_{min}$ | Note |
|---|---|---|---|---|
| None | — | 0.04 | 0.0 | Comparison |
| Compound (2) | 0.120 | 2.03 | 0.06 | Invention |
| Compound (10) | 0.095 | 2.05 | 0.07 | Invention |
| Compound (12) | 0.095 | 1.93 | 0.06 | Invention |

TABLE 2-continued

| Nucleating agent | Amount added mmol/mol AgBr | $D_{max}$ | $D_{min}$ | Note |
|---|---|---|---|---|
| Compound (21) | 0.120 | 2.13 | 0.07 | Invention |
| Compound (22) | 0.095 | 2.15 | 0.07 | Invention |
| Compound A | 0.095 | 1.80 | 0.08 | Comparison |

EXAMPLE 3

Four color direct positive photosensitive sheets (A) to (D) were prepared by applying the layers shown below in the order shown on polyethylene terephthalate transparent bases.

(1) A mordant layer containing the following copolymer (3.0 g/m$^2$) and gelatin (3.0 g/m$^2$).

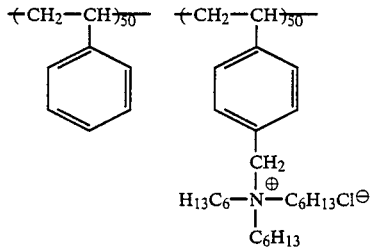

(2) A white reflective layer containing titanium oxide (18 g/m$^2$) and gelatin (2.0 g/m$^2$).

(3) A light screening layer containing carbon black (2.0 g/m$^2$) and gelatin (1.0 g/m$^2$).

(4) A layer containing a magenta DRR compound (0.21 g/m$^2$) having a structural formula I given below, a magenta DRR compound (0.11 g/m$^2$) having a structural formula II given below, tricyclohexyl phosphate (0.08 g/m$^2$), 2,5-di-tert-pentadecylhydroquinone (0.009 g/m$^2$) and gelatin (0.9 g/m$^2$).

Structural formula I:

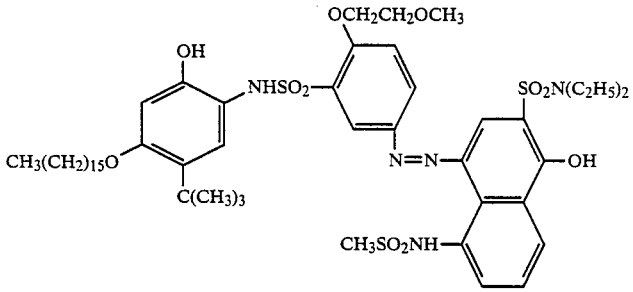

Structural formula II:

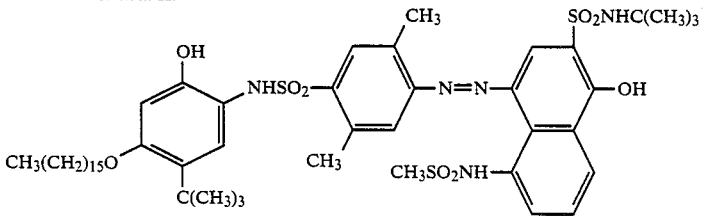

(5) A green sensitive emulsion layer containing a dye-sensitized internal latent image type direct positive silver bromide emulsion (0.82 g (in terms of silver)/m$^2$), gelatin (0.9 g/m$^2$), 2-sulfo-5-n-pentadecylhydroquinone sodium salt (0.08 g/,$^2$) and respective nucleating agents according to the invention ($10^{-10}$ mol to $10^{-9}$ mol/g of the emulsion).

(6) A protective layer containing gelatin (1.0 g/m$^2$).

The above photosensitive sheets (A) to (D) were associated with the following processing element and cover sheet, then were exposed to light and were developed.

Processing Element

Container that can be broken by pressure made of lead foil filled with a processing solution.

| Processing Solution | |
|---|---|
| 1-Phenyl-4-methyl-4-hydroxymethyl-3-pyrazolidone | 8.0 g |
| Tert-butylhydroquinone | 0.1 g |
| 5-Methylbenzotriazole | 2.5 g |
| Benzyl alcohol | 1.5 ml |
| Sodium sulfite (anhydride) | 1.5 g |
| Carboxymethylcellulose sodium salt | 61 g |
| Zinc nitrate hexahydrate | 0.4 g |
| Carbon black | 410 g |
| Potassium hydroxide | 56 g |
| $H_2O$ | 260 ml |

Each container that could be broken by pressure was filled with 0.8 g of the processing solution having the above composition.

Cover Sheet

A cover sheet ws prepared by coating a polyethylene terephthalate base with as an acid polymer layer (a neutralizing layer), a polyacrylic acid (having a viscosity of about 1,000 cp as an aqueous 10 wt % solution) (15 g/m$^2$), as a neutralization timing layer thereon an acetylcellulose (3.8 g/m$^2$), and a copolymer of styrene and maleic anhydride (the molar ratio of styrene to maleic anhydride=about 60:40, the molecular weight: about 50,000) (0.2 g/m$^2$).

Processing Step

The cover sheet and each of the above photosensitive sheets were put together, and were subjected to wedge exposure for 1/100 second from the cover sheet side by using a tungsten light source, and the above processing solution was developed between the sheets using press rolls so that the thickness of the processing solution might be 100 μ. Development processing was carried out at 25° C. One hour after processing, the green density of the image produced in the image receiving layer was measured via the transparent base of the photosensitive sheet by a Macbeth reflection densitometer. The results are shown in Table 3.

From Table 3, it can be seen that the present nucleating agents exhibit good reversibility in the case of the instant color direct positive photosensitive materials.

TABLE 3

| Photo sensitive material | Nucleating agent | Amount added mmol/g of emulsion | $D_{max}$ | $D_{min}$ | Note |
|---|---|---|---|---|---|
| A | None | — | 0.05 | 0.05 | Comparison |
| B | Compound (1) | $8.0 \times 10^{-6}$ | 1.85 | 0.06 | Invention |
| C | Compound (11) | $5.0 \times 10^{-6}$ | 2.01 | 0.08 | Invention |
| D | Compound (18) | $5.0 \times 10^{-6}$ | 2.15 | 0.07 | Invention |
| E | Compound (21) | $8.0 \times 10^{-6}$ | 2.05 | 0.06 | Invention |
| F | Compound (22) | $3.0 \times 10^{-6}$ | 2.18 | 0.07 | Invention |

EXAMPLE 4

Each of emulsions prepared by adding the above Comparative Example A, each of nucleating agents according to the invention, and a sensitizing dye E ($9.5 \times 10^{-5}$ mol) (shown below) to 1 kg of a silver bromide emulsion (having a [100] plane) prepared according to the usual method was applied and dried on a triacetate film base to produce a photographic material.

Each of the thus produced photographic materials was subjected to optical wedge exposure (0.1 sec) at 3200 luxes using a yellow filter (SC-46 manufactured by Fuji Photo Film Co., Ltd.).

Each of the photographic materials was developed for 5 minutes at 20° C. using a developing solution having the composition shown below, followed by stop, fixing and washing steps to obtain a strip having a prescribed black and white image. The density thereof was measured by a TCD type densitometer manufactured by Fuji Photo Film Co., Ltd. to obtain the yellow filter sensitivity ($S_Y$) and the fog value.

The obtained results, wherein the standard point of the optical density that determines the sensitivity was given by [fog+0.10], are shown as relative values in Table 4.

| Composition of Developing Solution | |
|---|---|
| Water | 500 ml |
| Metol | 2 g |
| Sodium sulfite anhydride | 90 g |
| Hydroquinone | 8 g |
| Sodium carbonate monohydrate | 52.5 g |
| Potassium bromide | 5 g |
| Water to make | 1 liter |

As is apparent from Table 4, the compounds according to the present invention substantially enhance photographic sensitivity in comparison to Comparative Example A.

TABLE 4

| Compound according to the Invention | Amount added mmol/kg of emulsion | Relative Sensitivity | Density of Fogging | Note |
|---|---|---|---|---|
| None | — | 100 (Standard) | 0.04 | Comparison |
| Compound (4) | $4.0 \times 10^{-3}$ | 143 | 0.04 | Invention |
| Compound (19) | $4.0 \times 10^{-3}$ | 165 | 0.04 | " |
| Compound (21) | $4.0 \times 10^{-3}$ | 155 | 0.04 | " |
| Compound (22) | $4.0 \times 10^{-3}$ | 165 | 0.04 | " |
| Compound A | $4.0 \times 10^{-3}$ | 141 | 0.04 | Comparison |

Sensitizing Dye E:

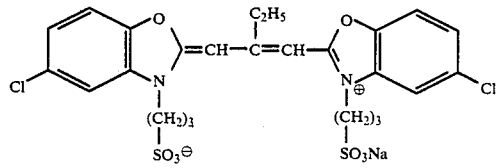

EXAMPLE 5

Preparation of Emulsion A

An aqueous solution of potassium bromide and an aqueous solution of silver nitrate were added simultaneously to an aqueous gelatin solution, to which 3,4-dimethyl-1,3-thiazoline-2-thion had been added in an amount of 0.3 g per mol of Ag, at about 75° C. over a period of about 20 minutes with vigorous stirring to produce an octahedron monodispersed silver bromide emulsion having an average grain diameter of 0.4 μm.

To the emulsion were added sodium thiosulfate and chloroauric acid (tetrahydrate), each in an amount of 10 mg per mol of silver, and the emulsion was chemically sensitized by heating for 40 minutes at 75° C.

Using the thus produced silver bromide grains as cores, the grains were further grown for 40 minutes under the same precipitation environment as that for the first period of crystal growth to finally produce an octahedron monodispersed core/shell silver bromide emulsion having an average grain diameter of 0.7 μm.

After washing the emulsions to desalt it, sodium thiosulfate and chloroauric acid (tetrahydrate), each in an amount of 4.5 mg per mol of silver, were added to the emulsion and the emulsion was chemically sensitized by heating at 60° C. for 40 minutes to produce an internal latent image type silver halide emulsion A. The coefficient of variation of the grain size was 10%.

Using the core/shell type internal latent image emulsion A, each color photographic paper having the layer structure shown in Table 1 on a paper base, the opposite surfaces of which had been laminated with polyethylene, was produced. The coating solutions were prepared as follows.

Preparation of a first coating solution: 10 ml of ethyl acetate and 4 ml of a solvent (c) were added to 10 g of a cyan coupler (a) and 2.3 g of a dye stabilizer (b), and the resulting solution was emulsified and dispersed in 90 ml of an aqueous 10% gelatin solution containing 5 ml of a 10% sodium dodecylbenzenesulfonate.

On the other hand, a red sensitive dye, shown below, in an amount of $2.0 \times 10^{-4}$ mol per mol of silver halide was added to the above silver halide emulsion containing 70 g Ag/kg to produce 90 g of a red sensitive emulsion. The emulsified dispersion, the emulsion and a development accelerator (d) were mixed and dissolved, the concentrations were adjusted by gelatin to have the composition shown in Table 5, and a nucleating agent was added as shown in Table 7 to prepare a coating solution for a first layer. Similarly, the nucleating agent was added to a third layer and a fifth layer.

Coating solutions for second to seventh layers were prepared in the same manner as that for the coating solution for the first layer.

In each layer, 1-oxy-3,5-dichloro-s-triazine sodium salt was used as a hardening agent.

TABLE 5

| Layer | Major components | Amount Used |
|---|---|---|
| Seventh Layer (protective layer) | Latex particles of polymethacrylate (average particle diameter: 2.8 μm) | 0.05 g/m² |
| | Gelatin | 1.33 g/m² |
| | Acryl-modified polyvinyl alcohol copolymer (degree of modification: 17%) | 0.17 g/m² |
| Sixth Layer (ultraviolet absorbing layer) | Gelatin | 0.54 g/m² |
| | Ultraviolet absorber (i) | $5.10 \times 10^{-4}$ mol/m² |
| | Solvent (k) | 0.08 g/m² |
| Fifth Layer (blue-sensitive layer) | Emulsion A silver: | 0.40 g/m² |
| | Gelatin | 1.35 g/m² |
| | Yellow color (l) | $6.91 \times 10^{-4}$ mol/m² |
| | Dye image stabilizer (m) | 0.13 g/m² |
| | Solvent (h) | 0.02 g/m² |
| | Development Accelerator (d) | 32 mg/m² |
| | Nucleating agent | |
| Fourth Layer (ultraviolet absorbing layer) | Gelatin | 1.60 g/m² |
| | Colloidal silver | 0.10 g/m² |
| | Ultraviolet absorber (i) | $1.70 \times 10^{-4}$ mol/m² |
| | Color mixing preventing agent (j) | $1.60 \times 10^{-4}$ mol/m² |
| | Solvent (k) | 0.24 g/m² |
| Third Layer (green-sensitive layer) | Emulsion A silver: | 0.18 g/m² |
| | Gelatin | 1.56 g/m² |
| | Magenta coupler (f) | $4.60 \times 10^{-4}$ mol/m² |
| | Dye image stabilizer (g) | 0.14 g/m² |
| | Solvent (h) | 0.42 g/m² |
| | Development accelerator (d) | 32 mg/m² |
| | Nucleating agent | |
| Second Layer (color mixing preventing layer | Gelatin | 0.90 g/m² |
| | Colloidal silver | 0.02 g/m² |
| | Color mixing preventing agent (e) | $2.33 \times 10^{-4}$ mol/m² |
| First Layer (red-sensitive layer) | Emulsion A silver: | 0.39 g/m² |
| | Gelatin | 0.90 g/m² |
| | Cyan coupler (a) | $7.05 \times 10^{-4}$ mol/m² |
| | Dye image stabilizer (b) | $5.20 \times 10^{-4}$ mol/m² |
| | Solvent (c) | 0.22 g/m² |
| | Development accelerator (d) | 32 mg/m² |
| | Nucleating agent | |
| Base | Polyethylene-laminated paper (the polyethylene on the first layer contained white pigments ($TiO_2$, etc.), bluish dyes (ultramarine, etc.) and the thickness was 135 μm). | |
| Curing preventing layer | Gelatin | 2.7 g/m² |

The following dyes were used as irradiation preventing dyes:

Irradiation preventing dye for the green-sensitive emulsion layer:

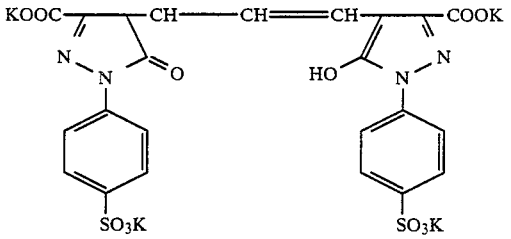

Irradiation preventing dye for the red-sensitive emulsion layer:

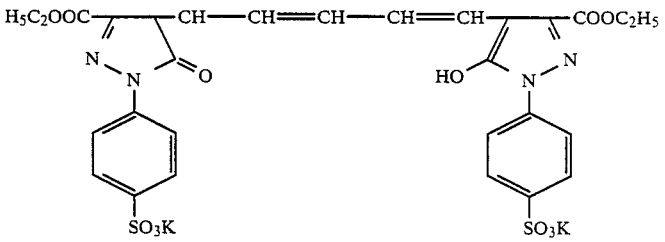

The following were used as spectral sensitizing dyes:

In red-sensitive emulsion layer:

-continued
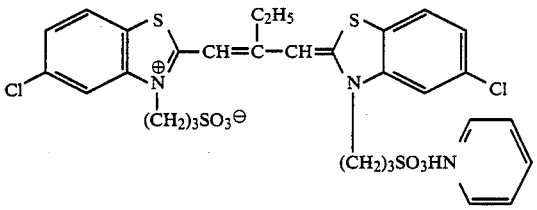
In green-sensitive emulsion layer:
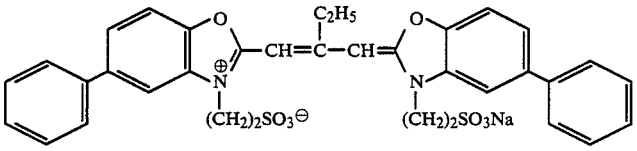
In blue-sensitive emulsion layer:
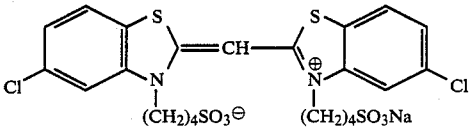
The structural formulae of the compounds including the couplers used in the Example are as follows:
Cyan coupler (a):
1:1 (by molar ratio) mixture of
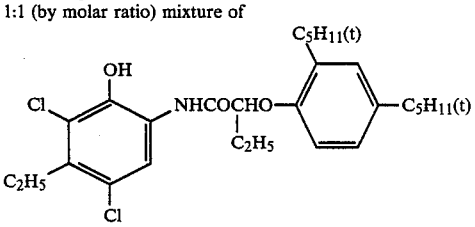
and
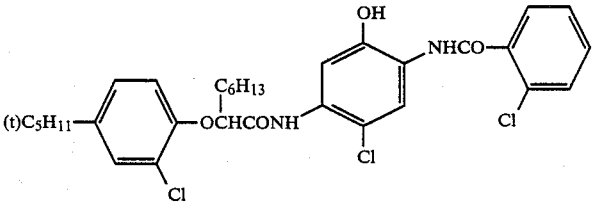
Dye image stabilizer (b):
1:3:3 (by molar ratio) mixture of
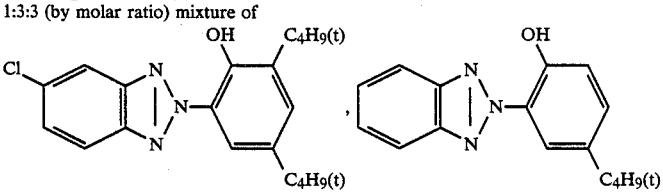
and
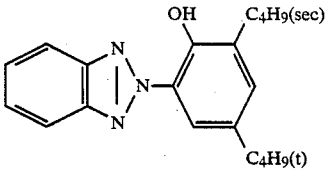

-continued
Solvent (c)
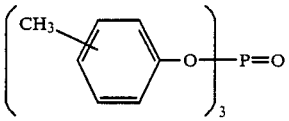
Development Accelerator (d)
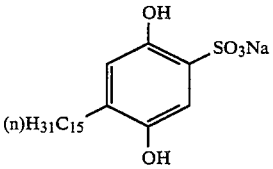
Color Mixing Preventing Agent (e)
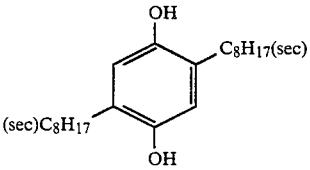
Magenta Coupler (f)
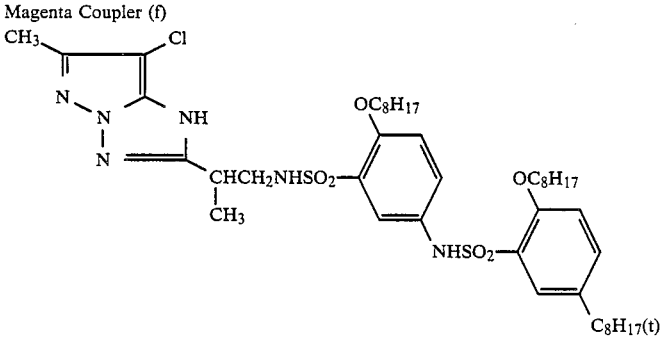
Dye Image Stabilizer (g)
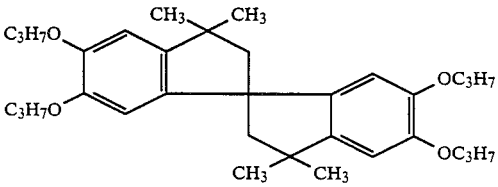
Solvent (h)
2:1 (by weight ratio) mixture of
$((n)C_8H_{17}O)_3P{=}O$ and
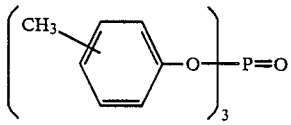
Ultraviolet Absorbing Agent (i)
1:5:3 (by molar ratio) mixture of
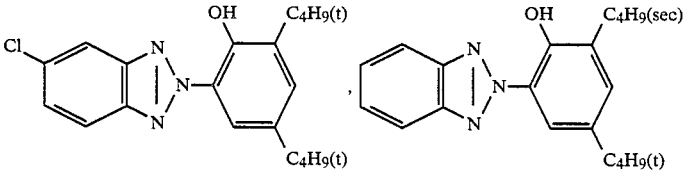
and -continued

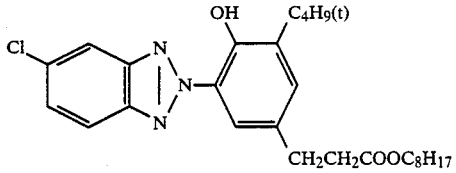

Color mixing preventing agent (j)

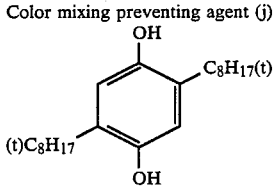

Solvent (k)

$(isoC_9H_{19}O)_3P{=}O$

Yellow coupler (l)

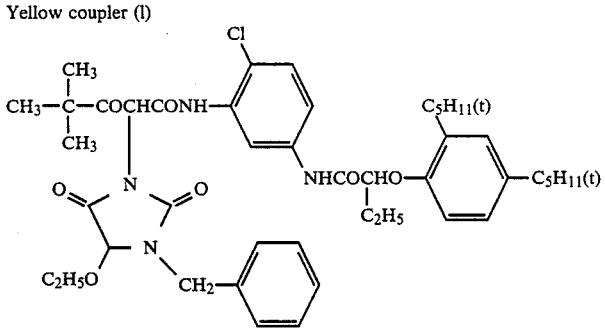

Dye image stabilizer (m)

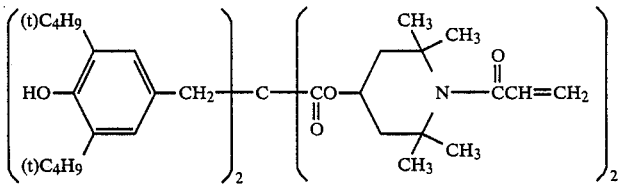

The thus prepared color photographic papers were kept in an atmosphere of 40% RH at 60° C. for 4 days (incubation). The samples that were subjected to the incubation and the samples that were not subjected to the incubation were subjected to wedge exposure (1/10 second, 10 CMS), and were subjected to a step A shown in Table 6, and the magenta color image density was measured.

TABLE 6

| Step A | Time | Temperature |
|---|---|---|
| Color development | 1 min 30 sec | 37° C. |
| Bleach-fix | 40 sec | 37° C. |
| Stabilization (1) | 20 sec | 37° C. |
| Stabilization (2) | 20 sec | 37° C. |
| Stabilization (3) | 20 sec | 37° C. |

The replenishing method of the stabilizing bath was the so-called countercurrent replenishing method, i.e., the replenishing solution was supplied to the stabilizing bath (3), the overflow from the stabilizing bath (3) was led to the stabilizing bath (2), and the overflow from the stabilizing bath (2) was led to the stabilizing bath (1).

| Color Developing Solution | |
|---|---|
| Diethylenetriaminetetraacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N—ethyl-N—(β-methanesulfonamidoethyl)aniline | 4.25 g |
| Potassium carbonate | 30.0 g |
| Brightening agent (stilbene type) | 1.0 g |
| Water to make | 1000ml |
| pH | 10.20 |

The pH was adjusted using potassium hydroxide or hydrochloric acid.

| Bleach-fix Solution | |
|---|---|
| Ammonium thiosulfate | 110 g |
| Sodium hydrogen sulfite | 10 g |
| Ammonium diethylenetriaminepentaacetato ferrate monohydrate | 56 g |
| Disodium ethylenediaminetetraacetate dihydrate | 5 g |
| 2-Mecapto-1,3,4-triazole | 0.5 g |
| Water to make | 1000 ml |
| pH | 6.5 |

The pH was adjusted using ammonia water or hydrochloric

-continued

| Color Developing Solution | |
|---|---|
| acid. | |
| **Stabilizing Solution** | |
| 1-Hydroxyethylidene-1,1'-diphosphonic acid (60%) | 1.6 ml |
| Bismuth chloride | 0.35 g |
| Polyvinyl pyrrolidone | 0.25 g |
| Ammonia water | 2.5 ml |
| Nitrilotriacetic acid · 3Na | 1.0 g |
| 5-Chloro-2-methyl-4-isothiazoline-3-one | 50 mg |
| 2-Octyl-4-isothiazoline-3-one | 50 mg |
| Brightening agent (4,4'-diaminostilbene type) | 1.0 g |
| Water to make | 1000 ml |
| pH | 7.5 |

The pH was adjusted using potassium hydroxide or hydrochloric acid.

TABLE 7

| | Exemplified Compound | | Before incubation | | After incubation | |
|---|---|---|---|---|---|---|
| No. | No. | mol/Agmol | Dmin | Dmax | Dmin | Dmax |
| 1 | 1 | $1.80 \times 10^{-4}$ | 0.10 | 2.3 | 0.11 | 2.2 |
| 2 | 2 | $5.60 \times 10^{-4}$ | 0.10 | 2.3 | 0.11 | 2.3 |
| 3 | 6 | $1.80 \times 10^{-4}$ | 0.10 | 2.4 | 0.11 | 2.3 |
| 4 | 10 | $1.80 \times 10^{-5}$ | 0.10 | 2.3 | 0.11 | 2.2 |
| 5 | 12 | $1.80 \times 10^{-5}$ | 0.10 | 2.3 | 0.11 | 2.2 |
| 6 | 13 | $1.80 \times 10^{-4}$ | 0.10 | 2.4 | 0.11 | 2.3 |
| 7 | 21 | $1.80 \times 10^{-4}$ | 0.10 | 2.4 | 0.11 | 2.3 |
| 8 | 22 | $1.80 \times 10^{-5}$ | 0.10 | 2.4 | 0.11 | 2.4 |
| 9 | Comparative Example 1 | $1.80 \times 10^{-4}$ | 0.10 | 2.2 | 0.15 | 1.9 |
| 10 | Comparative Example 2 | $1.80 \times 10^{-4}$ | 0.10 | 2.2 | 0.5 | 0.5 |

Comparative Example 1:

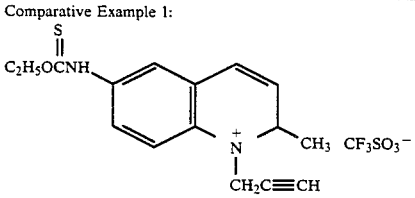

Comparative Example 2:

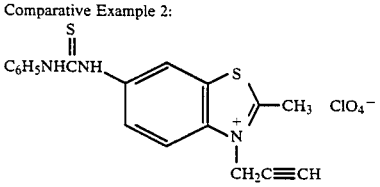

In comparison to Sample Nos. 9 and 10 (Comparative Examples), Sample Nos. 1 to 8 that used the present nucleating agents were superior in that the decrease in the maximum density and the increase in the minimum density due to the incubation were less.

With respect to the cyan density and the yellow density, similar results were obtained.

When samples containing Exemplified Compounds 3, 4, 5, 6, 9, and 10, each in an amount of $1.80 \times 10^{-4}$ mol/mol of silver, or Exemplified Compound 11, 14, 15, 16, 17 and 18, each in an amount of $1.80 \times 10^{-5}$ mol/mol of silver were used, instead of the respective Exemplified Compound shown in Table 7, similar results were obtained.

EXAMPLE 6

Example 1 was repeated, except that the following yellow coupler was used:

Yellow coupler (n)

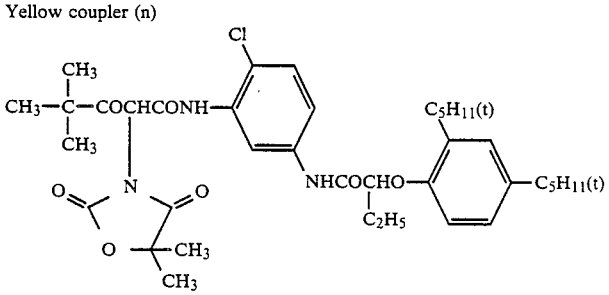

The third layer was made as shown in Table 8 and the nucleating agents shown in Table 9 were added to the first, third and fifth layers.

Magenta coupler (o)

-continued

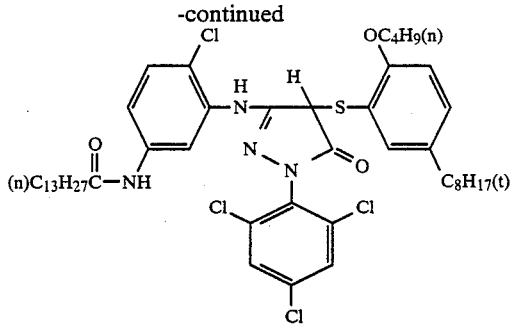

TABLE 8

| | | Amount of silver Present |
|---|---|---|
| Third Layer (green-sensitive layer) | Emulsion A | 0.39 g/m$^2$ |
| | Gelatin | 1.56 g/m$^2$ |
| | Magenta coupler (o) | 4.60 × 10$^{-4}$ mol/m$^2$ |
| | Dye image stabilizer (p) | 0.14 g/m$^2$ |
| | Solvent (q) | 0.42 g/m$^2$ |
| | Development accelerator (d) | 32 mg/m$^2$ |
| | Nucleating agent | |

(p) Dye image stabilizer:

1:1.5 (by weight) mixture of

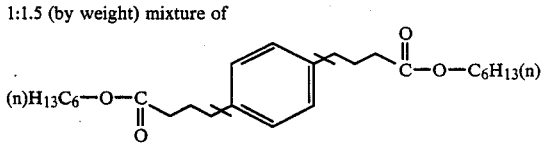

and

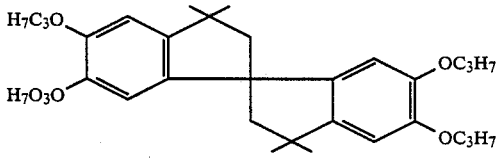

(q) Solvent:

1:2:2 (by weight) mixture of

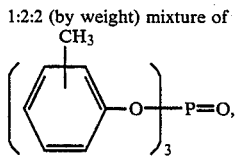

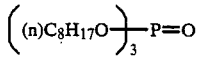

and

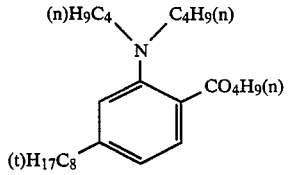

The color photographic papers were exposed to light in the same manner as in Example 5 and were subjected to the same process as step A in Example 5 using a color developing solution that has been run at 38° C. for 16 hours.

TABLE 9

| No. | Exemplified Compound No. | mol/Ag mol | Graininess** (relative assessment) |
|---|---|---|---|
| 11 | 1 | 1.80 × 10$^{-4}$ | 5 |
| 12 | 3 | " | 5 |
| 13 | 6 | " | 5 |
| 14 | 7 | 3.40 × 10$^{-5}$ | 5 |
| 15 | 8 | 1.80 × 10$^{-4}$ | 5 |
| 16 | 15 | 1.80 × 10$^{-5}$ | 5 |
| 17 | 19 | 3.40 × 10$^{-6}$ | 5 |
| 18 | 21 | 1.80 × 10$^{-5}$ | 5 |
| 19 | 22 | 3.40 × 10$^{-6}$ | 5 |
| 20 | Comparative Example 1* | 1.80 × 10$^{-4}$ | 3 |
| 21 | Comparative Example 2* | " | 3 |

*Comparative Examples 1 and 2 are the same as those in Example 1.
**The greater the value, the better the graininess.

As is apparent from Table 9, the graininess of Sample Nos. 11 to 19 that used the present nucleating agents was good even when they were processed using the fatigued processing solution.

EXAMPLE 7

Example 5 was repeated, except that nucleation accelerator A-9 was added to the first, third and fifth layers in an amount of 2.8×10$^{-4}$ mol/mol of silver, the amount of the added nucleating agent was reduced to 1/10, and the color developing time was 1 minute 15 seconds. The results were the same.

EXAMPLE 8

Example 7 was repeated, except that nucleation accelerators A-2, A-3, A-4, A-5, A-10, A-11, A-12 and A-13 were used. The results were the same.

EXAMPLE 9

Samples in Example 5 were subjected to step A, except that the amount of sodium bromide in the color developing solution, that is, 0.10 g/liter, was changed to 0.50 g/liter. In comparison to Comparative Sample Nos. 9 to 10, the sensitivity of Sample Nos. 1 to 8 containing the present nucleating agents changed little.

EXAMPLE 10

Example 9 was repeated, except that the samples in Examples 7 and 8 were used. The results were the same.

EXAMPLE 11

Examples 5, 6, 7, 8, 9 and 10 were repeated, except that the stabilizing bath was changed to a bath that was prepared by passing tap water through a mixed bed type column filled with an H-type strong acid cation exchange resin (Diaion SK-1B manufactured by Mitsubishi Chemical Industries, Ltd.) and an OH-type strong basic anion exchange resin (Diaion SA-10A manufactured by Mitsubishi Chemical Industries, Ltd.) to cause the water to have calcium ions in an amount of 1.1 mg/liter, and magnesium ions in an amount of 0.5 mg/liter and a pH of 6.9 and adding, as bacteriocide, isocyanuric dichloride sodium in an amount of 20 mg/liter to the water. The same results were obtained.

When nucleating agents according to the present invention are used, a direct positive image high in Dmax and low in Dmin can be obtained even if a developing solution relatively low in pH is used.

Spectral sensitization is not hampered and a direct positive image good in graininess can be obtained even if a fatigued running solution is used when nucleating agents according to the present invention are employed.

After a photosensitive material containing a nucleating agent according to the present invention is kept at high temperature and/or high humidities, then when it is developed, the decrease in Dmax and the increase in Dmin are small in comparison with that of the same photosensitive material developed immediately after its production.

When a nucleating agent according to the present invention is contained in a negative type photosensitive material, wherein a latent image will be formed mainly on the surface of the grains, a high sensitivity can advantageously be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having provided thereon at least one photosensitive silver halide photographic emulsion layer, wherein the emulsion layer or at least one of the other hydrophilic colloid layers contains at least one nucleating agent which is an alkynyl-substituted heterocyclic quaternary ammonium salt represented by the formula:

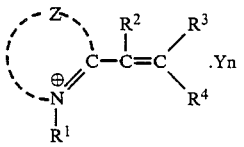

(I)

wherein Z represents a group of non-metallic atoms required to form a 5- to 6-membered heterocyclic ring, $R^1$ represents an aliphatic group, $R^2$, $R^3$ and $R^4$, which may be the same or different, each represents a hydrogen atom, an aliphatic group, or an aromatic group, at least one of $R^1$, $R^2$, $R^3$, $R^4$ and Z has at least one substituent having an alkynyl group, Y represents a counter ion for the charge balance, and n is a number required for change balance.

2. A silver halide photographic material as claimed in claim 1, wherein at least one of the substituents on $R^1$, $R^2$, $R^3$, $R^4$ and Z has at least one $-X\text{-}(L_m)\text{-}$ group in which X represents a group for accelerating absorption onto a silver halide, L represents a divalent linking group and m is 0 or 1.

3. A silver halide photographic material as claimed in claim 1, wherein the heterocyclic ring completed via Z is a quinolinium nucleus, a benzothiazolium nucleus, a benzamidazolium nucleus, a pyridinium nucleus, a thiazolinium nucleus, a thiazolium nucleus, a naphthothiazolinium nucleus, a selenazolium nucleus, a benzoselenazolium nucleus, an imidazolium nucleus, a tetrazolium nucleus, an indolenium nucleus, a pyrrolinium nucleus, an acridinium nucleus, an isoquinolinium nucleus, an oxazolinium nucleus, a naphthooxazolinium nucleus, a naphthopyridinium nucleus, or a benzoxazolium nucleus, which may or may not be substituted with substituents;

the aliphatic group is an unsubstituted alkyl group having 1 to 18 carbon atoms or a substituted alkyl group having 1 to 18 carbon atoms in the alkyl moiety; and the aromatic group has 6 to 20 carbon atoms and may be substituted or unsubstituted.

4. A silver halide photographic material as claimed in claim 3, wherein said at least one substituent having an alkynyl group contained in at least one of $R^1$, $R^2$, $R^3$, $R^4$ and Z has from 2 to 12 carbon atoms.

5. A silver halide photographic material as claimed in claim 4, wherein at least one of the substituents on $R^1$, $R^2$, $R^3$, $R^4$ and Z has at least one $-X\text{-}(L_m)\text{-}$ *group in which X represents a group for accelerating absorption onto a silver halide, L represents a divalent linking group and m is* 0 or 1.

6. A silver halide photographic material as claimed in claim 5, wherein the heterocyclic ring completed via Z is a quinolinium nucleus;

$R^1$ represents a propargyl group;

the at least one alkynyl-substituted group possessed by at least one of the substituents on $R^1$, $R^2$, $R^3$, $R^4$ and Z has a propargyl group;

X represents a thioamide group, a mercapto group or a 5- or 6-membered nitrogen-containing heterocyclic ring; and L represents an alkylene group, an alkenylene group, an alkynylene group, an arylene group, —O—, —SO—, —NH—, —N=, —CO—, or $SO_2$, which may or may not be substituted with substituents.

7. A silver halide photographic material as claimed in claim 1, wherein the silver halide photographic material is a positive type silver halide material and the alkynyl-substituted heterocyclic quaternary ammonium salt of formula (I) is incorporated into an internal latent image type silver halide emulsion layer.

8. A silver halide photographic material as claimed in claim 1, wherein the silver halide photographic material is a negative type silver halide photographic material and the alkynyl-substituted heterocyclic quaternary ammonium salt of formula (I) is incorporated into a surface latent image type silver halide emulsion layer.

9. A silver halide photographic material as claimed in claim 1, wherein the alkynyl-substituted heterocyclic quaternary ammonium salt of formula (I) is incorporated into a silver halide emulsion in an amount of from about $1\times10^{-8}$ mol to about $1\times10^{-2}$ mol per mol of silver in the silver halide emulsion.

10. A silver halide photographic material as claimed in claim 1, wherein the alkynyl-substituted heterocyclic quaternary ammonium salt of formula (I) is incorporated into a silver halide emulsion in an amount of from about $1\times10^{-7}$ mol to about $1\times10^{-3}$ mol per mol of silver in the silver halide emulsion.

* * * * *